US008449372B2

(12) United States Patent
Glenn, II et al.

(10) Patent No.: US 8,449,372 B2
(45) Date of Patent: May 28, 2013

(54) WAGERING GAME WITH A TABLE-GAME CONFIGURATION

(75) Inventors: Robert J. Glenn, II, Chicago, IL (US); Paul M. Lesley, Blue Island, IL (US); James M. Rasmussen, Chicago, IL (US); Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 377 days.

(21) Appl. No.: 12/742,097

(22) PCT Filed: Nov. 10, 2008

(86) PCT No.: PCT/US2008/083004

§ 371 (c)(1),
(2), (4) Date: May 9, 2010

(87) PCT Pub. No.: WO2009/062161

PCT Pub. Date: May 14, 2009

(65) Prior Publication Data

US 2010/0279757 A1 Nov. 4, 2010

Related U.S. Application Data

(60) Provisional application No. 61/002,522, filed on Nov. 9, 2007.

(51) Int. Cl.
*A63F 9/24* (2006.01)

(52) U.S. Cl.
USPC ..... 463/17; 463/16; 463/34; 273/139

(58) Field of Classification Search
USPC ..... 463/1, 31, 33, 34, 17
See application file for complete search history.

(56) References Cited

U.S. PATENT DOCUMENTS

| | | | | |
|---|---|---|---|---|
| 5,552,839 | A * | 9/1996 | Kuhl | 348/744 |
| 7,946,912 | B1 * | 5/2011 | Rennard | 463/17 |
| 2004/0239890 | A1 * | 12/2004 | Starkweather | 353/69 |
| 2005/0192094 | A1 * | 9/2005 | Okada et al. | 463/34 |
| 2006/0035707 | A1 * | 2/2006 | Nguyen et al. | 463/29 |
| 2007/0004510 | A1 | 1/2007 | Underdahl et al. | |
| 2007/0010318 | A1 | 1/2007 | Rigsby et al. | |
| 2007/0060259 | A1 | 3/2007 | Pececnik | |
| 2007/0201863 | A1 | 8/2007 | Wilson et al. | |
| 2008/0248866 | A1 * | 10/2008 | Cove | 463/25 |
| 2009/0108532 | A1 * | 4/2009 | Darling | 273/309 |
| 2009/0115133 | A1 * | 5/2009 | Kelly et al. | 273/274 |

OTHER PUBLICATIONS

International Search Report for PCT/US2008/83004 mailed Jan. 9, 2009; (2 pages).

* cited by examiner

*Primary Examiner* — David L Lewis
*Assistant Examiner* — Shauna-Kay Hall
(74) *Attorney, Agent, or Firm* — Nixon Peabody LLP

(57) ABSTRACT

A gaming system projects video images representing a tangible object related to a wagering game, such as roulette, onto a contoured display surface. The contoured display surface has a shape that corresponds to the tangible object, such as a roulette wheel. The contoured display surface may also have at least one moving section that corresponds with movement of the tangible object. A controller in communication with the projector is programmed to cause the projector to project video images that at least partially depict a randomly selected outcome of the wagering game. The gaming system provides the visual appeal, entertainment value, and dynamic nature of video images while retaining physical features that players typically expect when playing roulette.

32 Claims, 17 Drawing Sheets

WAGERING GAME WITH A TABLE-GAME CONFIGURATION

CROSS REFERENCE TO RELATED APPLICATIONS

This application is a U.S. National stage of International Application No. PCT/US2008/083004, filed Nov. 10, 2008, which is related to and claims priority to U.S. Provisional Application No. 61/002,522, filed Nov. 9, 2007, which is incorporated herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to wagering games, and more particularly, to a wagering game system with a table-game configuration.

BACKGROUND OF THE INVENTION

Casinos and other gaming establishments often include both gaming machines, for example, slot machines providing slot games and gaming tables providing table games such as craps or roulette. As a result, many game play options are available to patrons of the gaming establishments. Interestingly, whether due to human nature, risk tolerance, economics, skills, game familiarity, etc., it has been observed that some patrons consistently prefer gaming machine play while others prefer table game play. Shrewd gaming establishment operators consequently strive to offer a proper balance between entertaining and exciting gaming machines that encourage frequent and extended play, and fast paced gaming tables offering games such as blackjack, roulette, craps, keno, baccarat, etc., where wagering amounts per game are often substantial.

Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Operators consequently strive to employ the most entertaining and exciting machines, features, and enhancements available because such machines attract frequent play and hence increase profitability to the operator. The use of video with gaming machines has significantly increased the entertainment value and thus the popularity of gaming machines.

As is known, in addition to having an electro-mechanical configuration, a gaming machine may be configured as a video gaming machine to provide video slots, video poker, video blackjack, video keno, video bingo, video pachinko, video lottery, etc., to provide a spinning reel slots game. As is also known, video gaming machines include at least one video display for displaying video game images (e.g., simulated reel symbol arrays, simulated cards, simulated numbers, etc.) and may additionally include a touch screen to allow player interaction.

Thus, to achieve the desired balance between gaming tables and these entertaining and exciting video-enhanced gaming machines, there is a need to correspondingly increase the entertainment value and popularity of gaming tables with the use of video elements.

SUMMARY OF THE INVENTION

Some traditional gaming machines include a cathode ray tube (CRT) to display a wagering game to the player. A CRT is a video display having an electron gun that fires electrons toward a curved phosphor-coated screen within a glass envelope. Coils surrounding the glass envelope cause the electrons to bend, hitting different parts of the fluorescent screen, and the interaction by the electrons with the phosphorous screen causes visible light to be emitted. The distance between the electron gun and the screen is fixed and cannot be changed. The glass curve must be profiled to exacting dimensions to accommodate the bending of the electrons as they are fired toward the screen to prevent keystoning, a form of image distortion, and other visual artifacts. Moreover, the electrons are not in the visible light spectrum, but rather are converted to visible light when they excite the phosphorous coating on the interior of the screen.

By contrast, according to aspects disclosed herein, a gaming system including a contoured surface relative to which images are projected is provided. The distance between a projector that projects the images and the contoured surface may be varied, unlike in a CRT where the distance between the electron gun and the screen must remain fixed. In an aspect, the projector projects light in the visible light spectrum, unlike an electron gun in a CRT. Moreover, the contoured surface may be contoured according to any profile and is not limited by the characteristics of the projector from which the images are received by the contoured surface. The images from the projector are either reflected off of the contoured surface or pass through the contoured surface. The contoured surface may be swapped for a different contoured surface and any distance adjustments relative to the projector may be made concurrently.

In an embodiment, a gaming system includes: a projector configured to project video images representing a tangible object related to a wagering game; a contoured display surface positioned to receive the video images from the projector, the contoured display surface having a shape corresponding to the tangible object; and a controller in communication with the projector, the controller being programmed to cause the projector to project the video images relative to the contoured display surface, the video images at least partially depicting a randomly selected outcome of the wagering game.

In another embodiment, a gaming system includes: a projector configured to project an image associated with a wagering game; a contoured display surface configured to receive the image from the projector for viewing by one or more players, the contoured display surface having a plurality of contours configured to provide structure to portions of the image; and a controller in communication with the at least one projector, the controller being programmed to display, via the projector, the image on the contoured display surface.

In a further embodiment, a gaming system includes: a projector; a contoured display surface separated from the projector and positioned a distance from the projector that can be varied, the projector projecting video images through the contoured display surface or reflecting the video images off of the contoured display surface such that the video images are viewable relative to the contoured display surface, the video images representing a tangible object related to a theme of a wagering game; and a controller operatively coupled to the projector, the controller programmed to cause the projector to project the video images toward the contoured display surface at least as a function of the distance between the projector and the contoured display surface, the video images at least partially depicting a randomly selected outcome of the wagering game.

In yet another embodiment, a gaming system includes: a projector configured to project video images representing a tangible object related to a wagering game; a display surface positioned to receive the video images from the projector, the display surface having at least one moving section that moves physically while receiving at least some of the video images from the projector; and a controller in communication with the projector, the controller being programmed to cause the projector to project the video images relative to the display surface, the video images at least partially depicting a randomly selected outcome of the wagering game.

In an example embodiment, a gaming system with a table-game configuration projects video images onto a contoured surface, so that the combination of video images and the contoured surface resemble a conventional roulette wheel. In a further example, the contoured surface may include a section that physically moves relative to other stationary sections of the contoured surface to simulate the moving parts of the conventional roulette wheel. For instance, the contoured surface may include a physically rotating annular surface to receive video images that represent the rotation of the pockets and corresponding outcome identifiers, e.g., numbers and colors, of a conventional roulette wheel. Advantageously, the gaming system provides the visual appeal, entertainment value, and dynamic nature of video images while retaining physical features that players typically expect when playing roulette.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
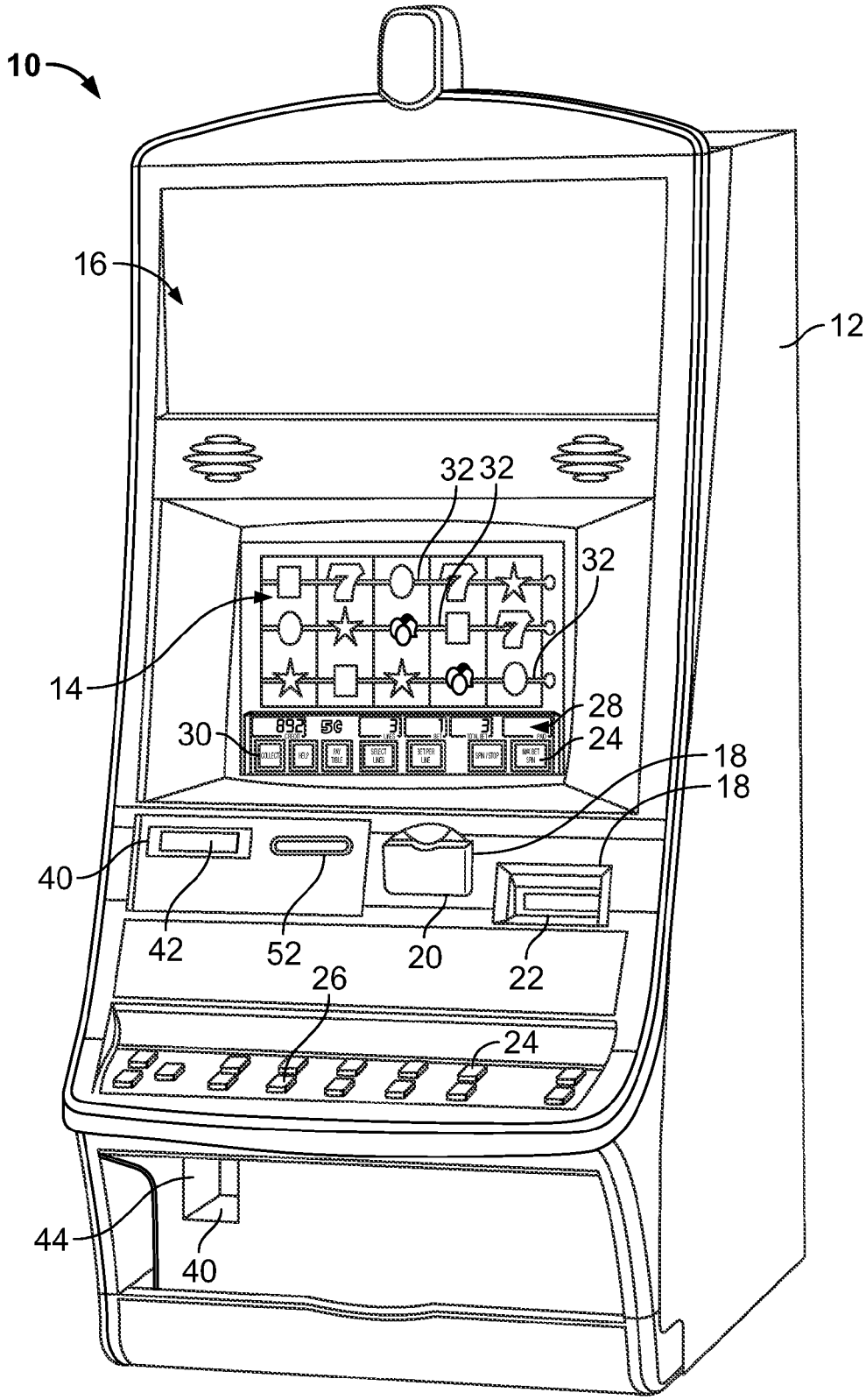
FIG. 1*a* is a perspective view of a free standing gaming machine.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
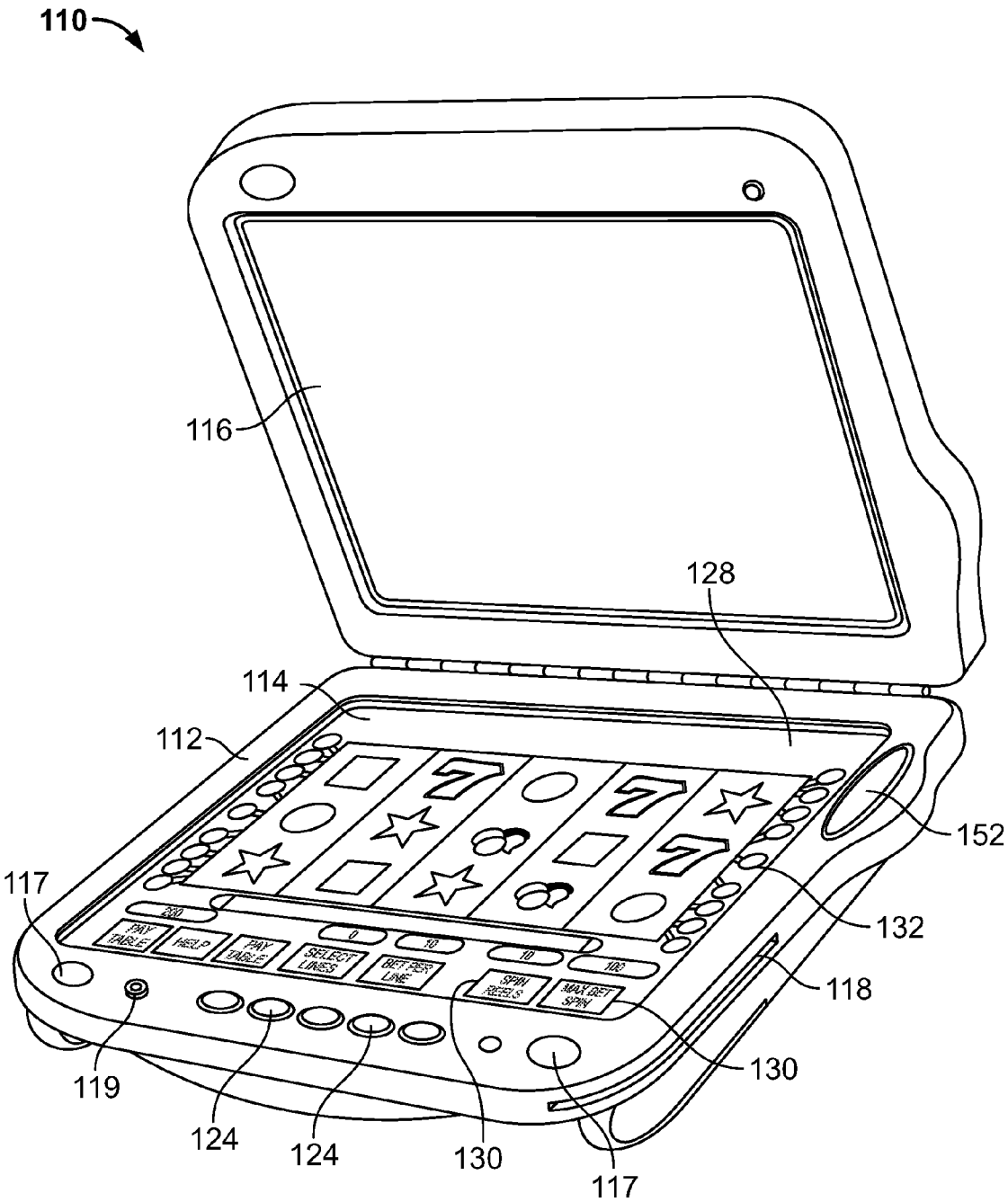
FIG. 1*b* is a perspective view of a handheld gaming machine.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
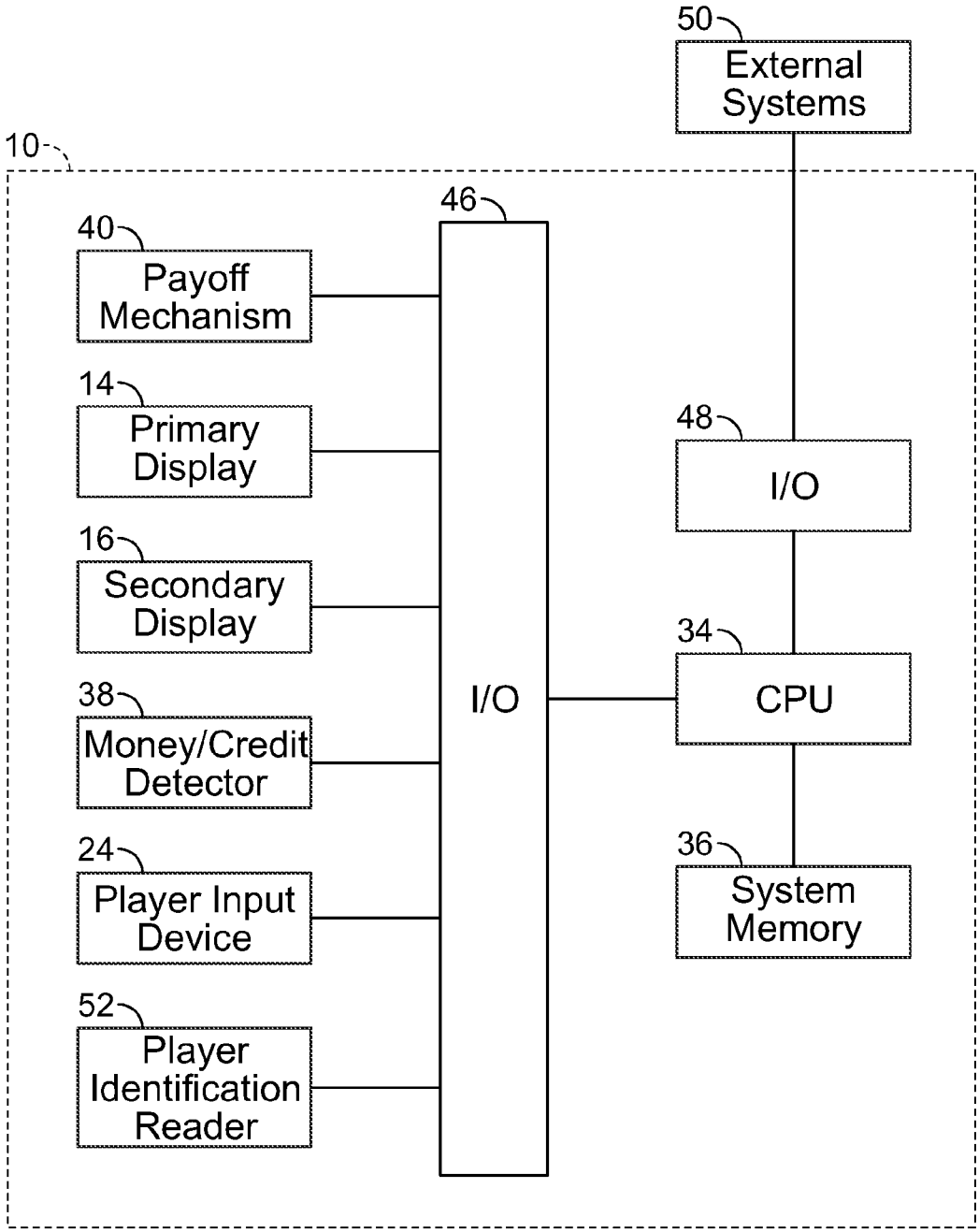
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications.

It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
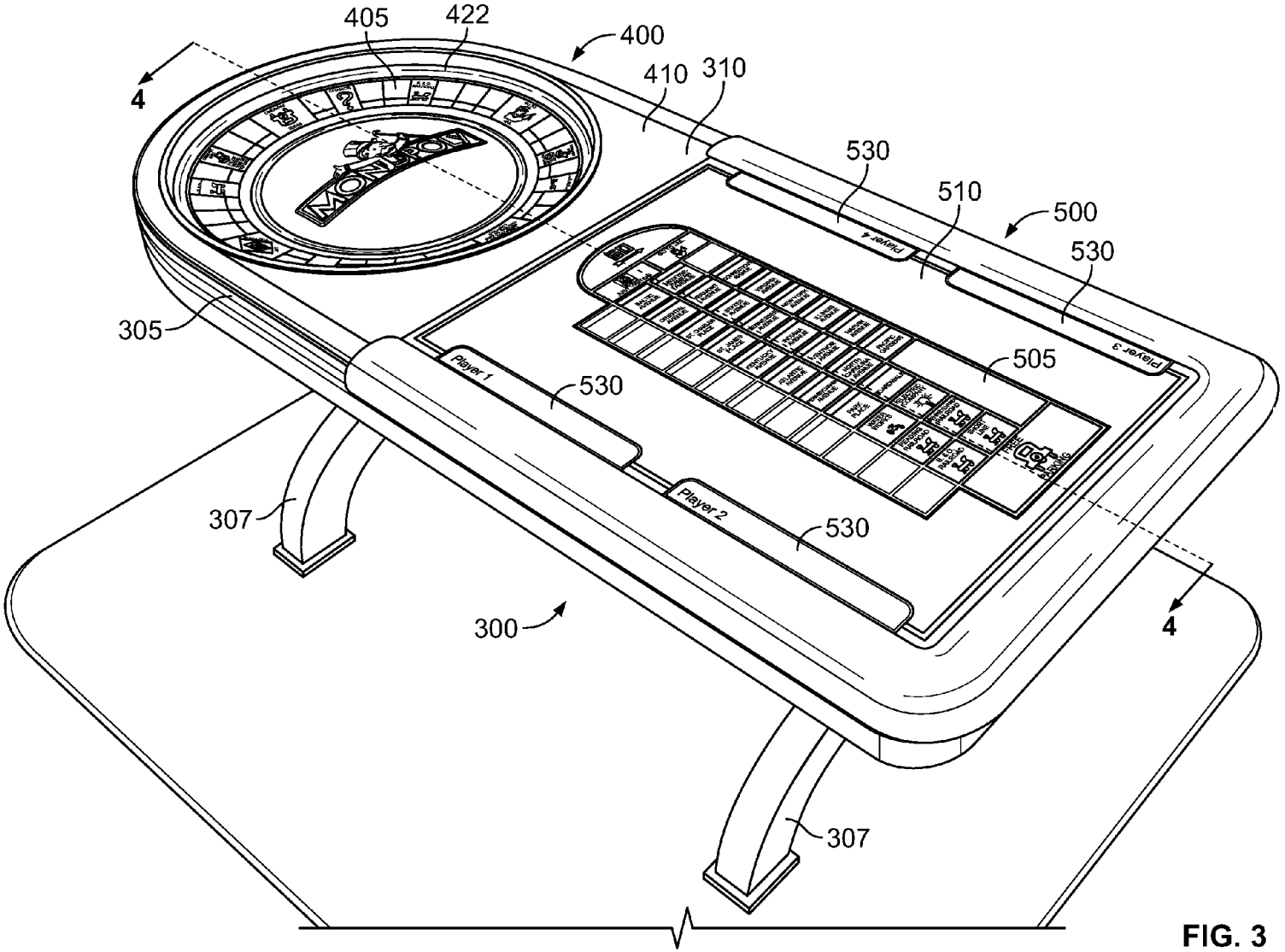
FIG. 3 is a perspective view of an embodiment of a gaming system with a table-game configuration.

FIG. 3 is a perspective view of an embodiment of a gaming system 300 with a table-game configuration. As shown in FIG. 3, the gaming system 300 includes a table having a tabletop 305. As described in further detail below, the tabletop 305 has a contoured surface that has the shape and visual elements of a roulette wheel. In general, the tabletop 305 is positioned at a level that enables one or more players to view the upper surface 310 of the tabletop 305 and participate in one or more wagering games. The level of the tabletop, for example, may permit players to sit around the tabletop 305 and/or stand around the tabletop 305. Although the tabletop 305 may be supported by a plurality of table legs 307, it is contemplated that other structures, such as a single columnar stand or a cabinet base, may be employed to stably support the tabletop 305.

The tabletop 305 may be organized into any number of sections to allow game play according to one or more wagering games. For example, as shown in FIG. 3, the tabletop 305 includes an outcome section 400 and a wagering section 500. The outcome section 400 provides one or more gaming elements 405 that determine and display outcomes according to one or more wagering games. Meanwhile, the wagering section 500 includes a wagering grid 505 that displays and receives wagers on the outcomes determined in the outcome section 400. Accordingly, the upper surface 310 of the tabletop 305 is formed from the surface 410 of the outcome section 400 and the surface 510 of the wagering section 500.

Figure 4:
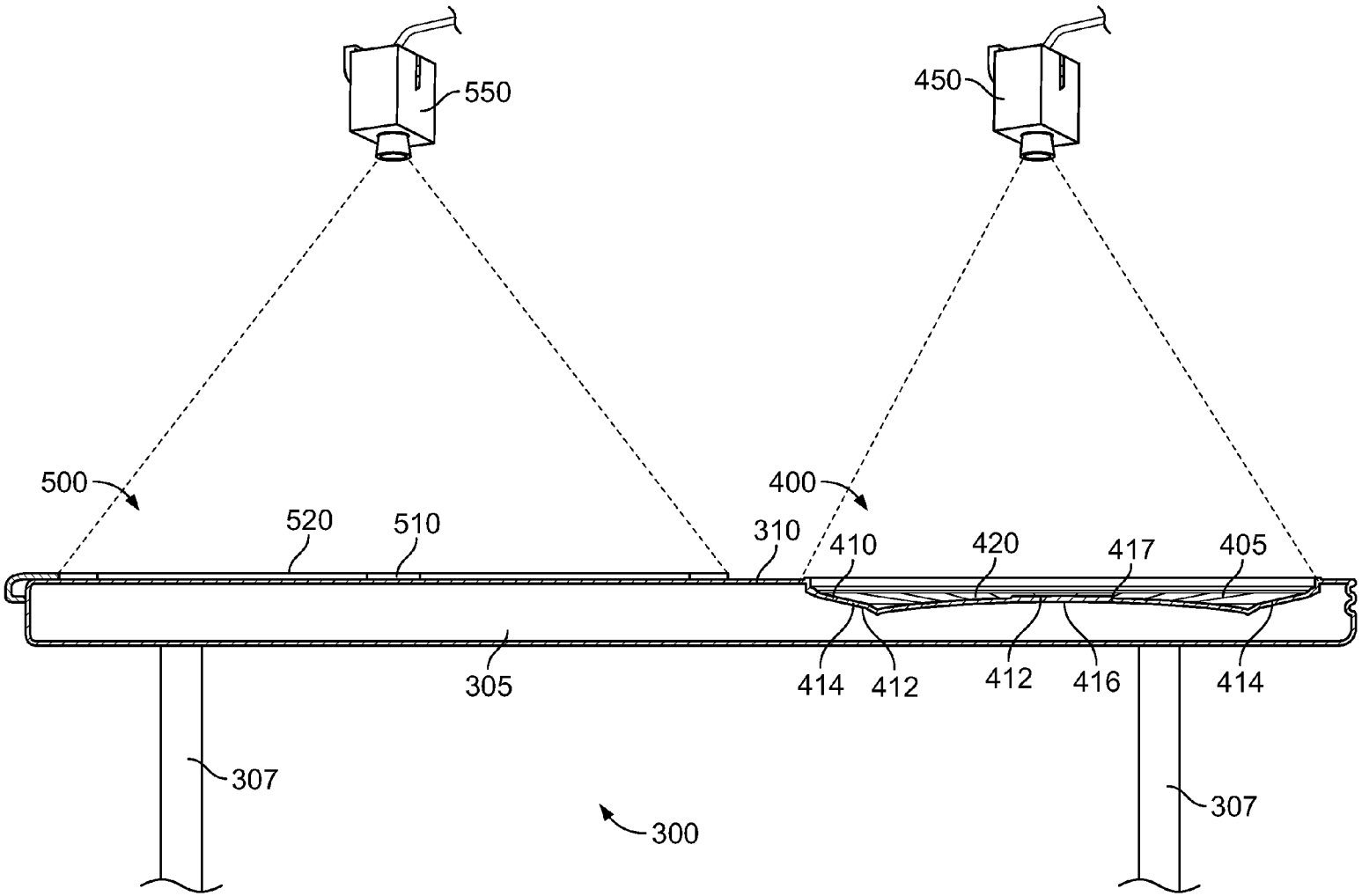
FIG. 4 is a side cross-sectional view of the embodiment of FIG. 3.

FIG. 4 illustrates a side cross-sectional view of the gaming system 300 with the cross-section taken as indicated in FIG. 3. As shown in FIG. 4, the gaming elements 405 of the outcome section 400 is formed from images 420 that are projected onto the surface 410 by a projector 450, i.e., "front projection." In general, however, a single projector or any number of projectors like the projector 450 of sufficient power may be employed to form the images 420 on the surface 410. The projector 450, as illustrated in FIG. 4, is positioned at a selectable or adjustable distance above the surface 410, and the light which forms the images 420 is transmitted downwardly onto the surface 410 where it is reflected upwardly to the eyes of the players or others viewing the surface 410. To maximize reflection of the projected images 420, the surface 410 comprises an opaque substrate, such as an opaque glass or plastic. The thickness of the substrate of the contoured surface 410 a front-projection system can generally be any thickness.

Figure 7:
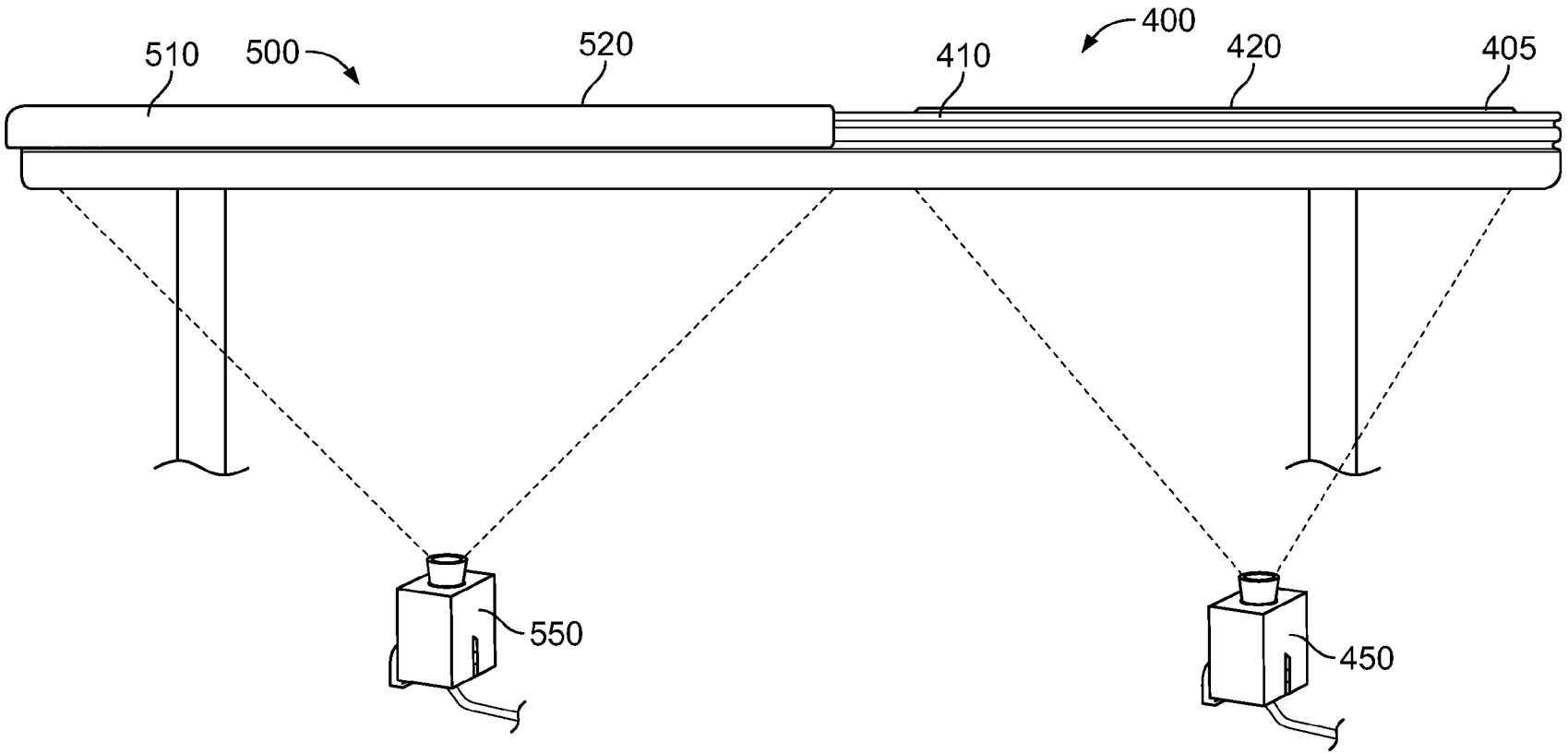
FIG. 7 is a side view of another embodiment of a gaming system with a table-game configuration.

Alternatively, as shown in FIG. 7, the projector 450 is positioned at a selectable or adjustable distance below the surface 410, and the light which forms the images 420 is transmitted upwardly through the surface 410, i.e., "rear projection." To permit the projected image 420 to be viewed from above the upper surface 410, the surface 410 permits images 420 to be passed through the surface 410 and displayed to people looking downwardly at the surface 410. In some cases, sharp features on the contoured surface 410 are minimized and smooth transitions between different contours are employed to minimize unwanted distortion in the images 420 projected through the surface 410.

In one example, the substrate for the contoured surface 410 is made of solid plastic which can be injection molded or thermal/cold formed. Alternatively, the substrate may be formed from a fabric that is rendered rigid by starch or other known methods. In general, the substrate should be sufficiently translucent so that the rear-projected images pass through the layer and are clearly visible to the players from above. If the substrate is not sufficiently opaque, the projected images may pass through the transparent layer without forming the images 420 on the surface 410. On the other hand, if the substrate is not sufficiently transparent, the light from the projector 450 may be blocked from reaching the top of the surface 410 so that the images cannot be viewed from above the surface 410. Accordingly, the surface 410 provides an appropriate balance between opacity and transparency.

In some cases, the thickness of the substrate may need to be thin to achieve the appropriate translucency. Although a substrate of minimal thickness may be more flexible, its structure may not be sufficiently sound for the contoured surface 410. As such, the contoured surface 410 may also be formed to achieve an appropriate balance between thickness and structural strength and integrity.

Although FIGS. 4 and 7 may show that the projector 450 is oriented vertically to permit immediate transmission of light to the surface 410, it is understood that the projector 450 may have other orientations, and where necessary, intermediate optical devices, such as mirrors or lenses, may be employed to focus or redirect the light to the surface. For example, instead of vertically transmitting the light, the projector 450 may transmit the light horizontally to a mirror which angles or redirects the light to the display surface 410. In some cases, the projector 450 is designed to be oriented for horizontal transmission, so using a redirecting mirror may help prevent overheating or other damage that may occur by orienting the projector 450 for vertical transmission. In general, variations in projector orientation and optical train configuration offer flexibility in the set-up of the gaming system 300. Examples of embodiments with different configurations are described further below.

Although the surface 410 may be substantially blank to receive and display the projected images 420, some visual elements may be more permanently applied, rather than projected, to the surface 410. In such embodiments, these applied images are displayed in combination with the projected images 420.

The projector 450 communicates with a controller that is programmed to determine which images 420 are to be projected via the projector 450. The controller may be any processing device, such as the controller 34 shown in FIG. 2, that executes programmed instructions on a storage media. For example, in the embodiment of FIG. 3, the controller 34 is programmed to cause the projector 450 to project images 420 that represent a conventional mechanical roulette wheel. As shown in greater detail in FIG. 5, the images 420 form an image 422 of a roulette wheel having outcome identifiers 424 arranged about a periphery 423. As is known, a game outcome of a conventional roulette wagering game is determined when an outcome identifier is randomly selected by a roulette ball that travels around the spinning roulette wheel and lands in a pocket that corresponds to the number.

The roulette wheel image 422 in the embodiment of FIG. 3 employs a MONOPOLY® theme, where each outcome identifier 424 corresponds with a different graphic element associated with the MONOPOLY® board game. Wagers in the embodiment of FIG. 3 are thus based on random selection of outcomes corresponding to different MONOPOLY® graphic elements. The graphic elements resemble the rectangular spaces on which players land when playing the MONOPOLY® board game. For instance, the graphic elements may correspond with twenty-two properties, divided into eight color groups of two or three properties, as well as four railways/stations, two utilities, "GO," "JUST VISITING," "GO TO JAIL," and "FREE PARKING." Of course, other themes may be implemented in other embodiments. Indeed, the projected images 420 may represent a conventional roulette wheel with outcome identifiers corresponding to the numbers 0, 00, and 1-36 organized into three colors (red, black, and green). Moreover, it is also understood that the images 420 are not limited to representation of a roulette wheel and may represent other wagering games.

As the side cross-sectional view of FIG. 4 also shows, the surface 410 is a shaped surface including one or more contours 412. The contours 412 correspond to structural characteristics of a conventional mechanical roulette wheel. In particular, FIGS. 3 and 4 show that the surface 410 includes a circumferential annular surface 414 that slopes upward as the annular surface extends radially outward. This annular sloping surface 414 corresponds to a similar structure along the circumference of a conventional roulette wheel. This structure on a conventional roulette wheel shows the outcome identifiers, i.e. numbers and colors, which correspond to the pockets of the roulette wheel. Therefore, by projecting images 420 of the outcome identifiers 424 onto the annular sloping surface 414, the outcome section 400 has the physical characteristics of an actual mechanical roulette wheel. Furthermore, the images 420 projected onto the annular surface 414 can provide an animated representation of a spinning mechanical roulette wheel and a roulette ball that travels along the spinning roulette wheel and eventually settles on one of the outcome identifiers 424 to randomly indicate the outcome for the wagering game. As such, the outcome section 400 includes structural as well as visual features that represent the operation of an actual mechanical roulette wheel and a roulette ball.

In aspects in which an actual roulette ball is not employed by the gaming system 300, the controller 34 may randomly select an outcome, for example, through a random number generator, and may correspondingly cause images 420 to be projected onto the contoured surface 410 and visually represent the selection of the outcome on a roulette wheel 422. In some embodiments, three-dimensional mathematical models simulate the real-world interactions of physical objects, such as the roulette ball on a spinning roulette wheel. An example of this technique is described in U.S. application Ser. No. 10/657,650 to Pacey et al., filed Sep. 8, 2003, and titled "GAMING MACHINE PERFORMING REAL-TIME 3D RENDERING OF GAMING EVENTS," the contents of which are entirely incorporated herein by reference. Of course, when a different wagering game is employed, the controller provides and generates images of an outcome that corresponds to the rules of that particular wagering game. Alternately, the images 420 may be pre-rendered and stored in the memory 36.

Advantageously, by projecting images 420 on the contoured surface 410, the gaming system 300 provides the visual appeal and entertainment value of video images while retaining physical features that players typically expect when playing a particular type of wagering game, such as roulette. Thus, players who may limit their play to a more traditional table game, such as roulette, may be drawn into playing variations of the traditional game provided by the gaming system 300. Indeed, the structural features also fulfill an instructional function. For instance, as the contoured surface 410 of the embodiment of FIG. 3 resembles a conventional mechanical roulette wheel, a new player may conclude from the combination of images 420 and the contoured surface 410 that the rules for the gaming system 300 are probably similar to the rules of traditional roulette games with which the player is already familiar. As such, a new player is more likely to feel comfortable with, and is more willing to place wagers on, the gaming system 300.

As another added benefit, the use of projected video images 420 enables visual wagering-game elements of the gaming system 300 to be quickly and easily changed to offer dynamic and entertaining variety. For instance, visual wagering-game elements may be changed according to various aspects of the game play. In an embodiment, each outcome identifier 424 may change size in proportion to the wagers placed on that particular outcome identifier 424, thus providing a dynamic visual indicator of the wagering action before an outcome is determined. For example, the entire roulette wheel image 422 may maintain the same size, but the general arc-length of each outcome identifier 424 in the wheel 422 becomes proportionally smaller or greater according to the size of the wagers on the outcome identifier 424. In a further embodiment, the entire projected wheel image 422 may grow or shrink in size according to the total number of wagers placed on the wagering game. It is particularly noted that although the contoured surface 410 does not actually physically change in size, the enlarged wheel image 422 provides the effect of creating a physically larger wheel. In an additional embodiment, the outcome identifiers 424 projected relative to the annular surface 414 may be altered to include different outcome identifiers 424 that provide different bonus game play or bonus awards. In another embodiment, recently selected outcome identifiers 424 may be highlighted or marked to provide players with information on previous outcomes. In yet another embodiment, animation may be employed on different areas of the outcome section 400 for visual entertainment during game play, for example, to highlight an outcome identifier 424 after it has been selected or to heighten the sense of anticipation as the roulette wheel spins. It is contemplated that the projected images 420, particularly for animation, may include audio as well as video components.

Additionally, the use of projected images 420 enables visual or aesthetic elements, such as the MONOPOLY® theme, to be easily and quickly changed, without requiring any physical changes to the table. In contrast, the visual elements of a traditional roulette wheel or other table game are generally static, and it is essentially impractical to provide a variety of visual themes without a substantial redesign and reconfiguration of hardware.

Figure 5:
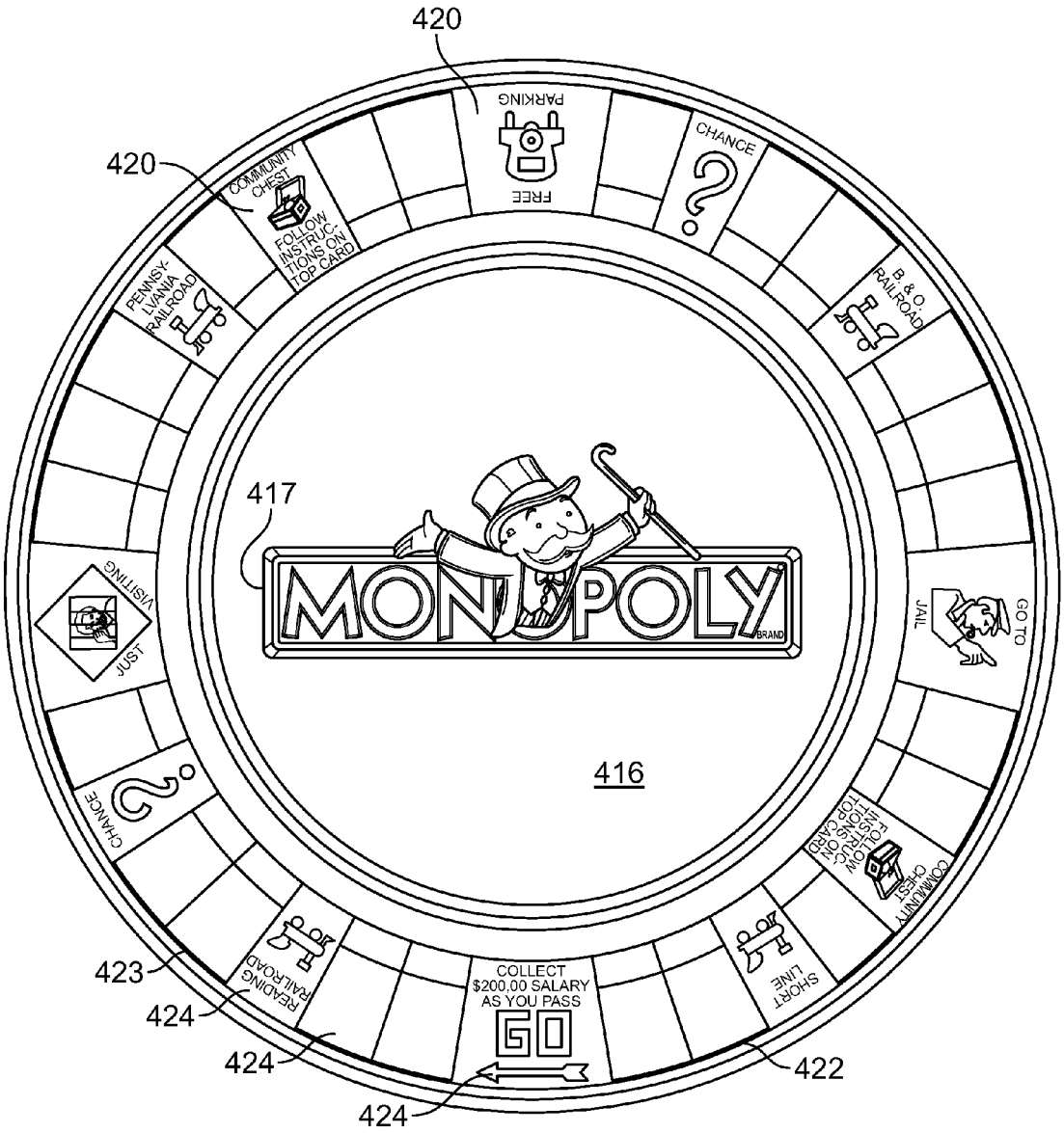
FIG. 5 is a top view of the projected image, on a contoured surface of the embodiment of FIG. 3, representing a roulette wheel.
Figure 10:
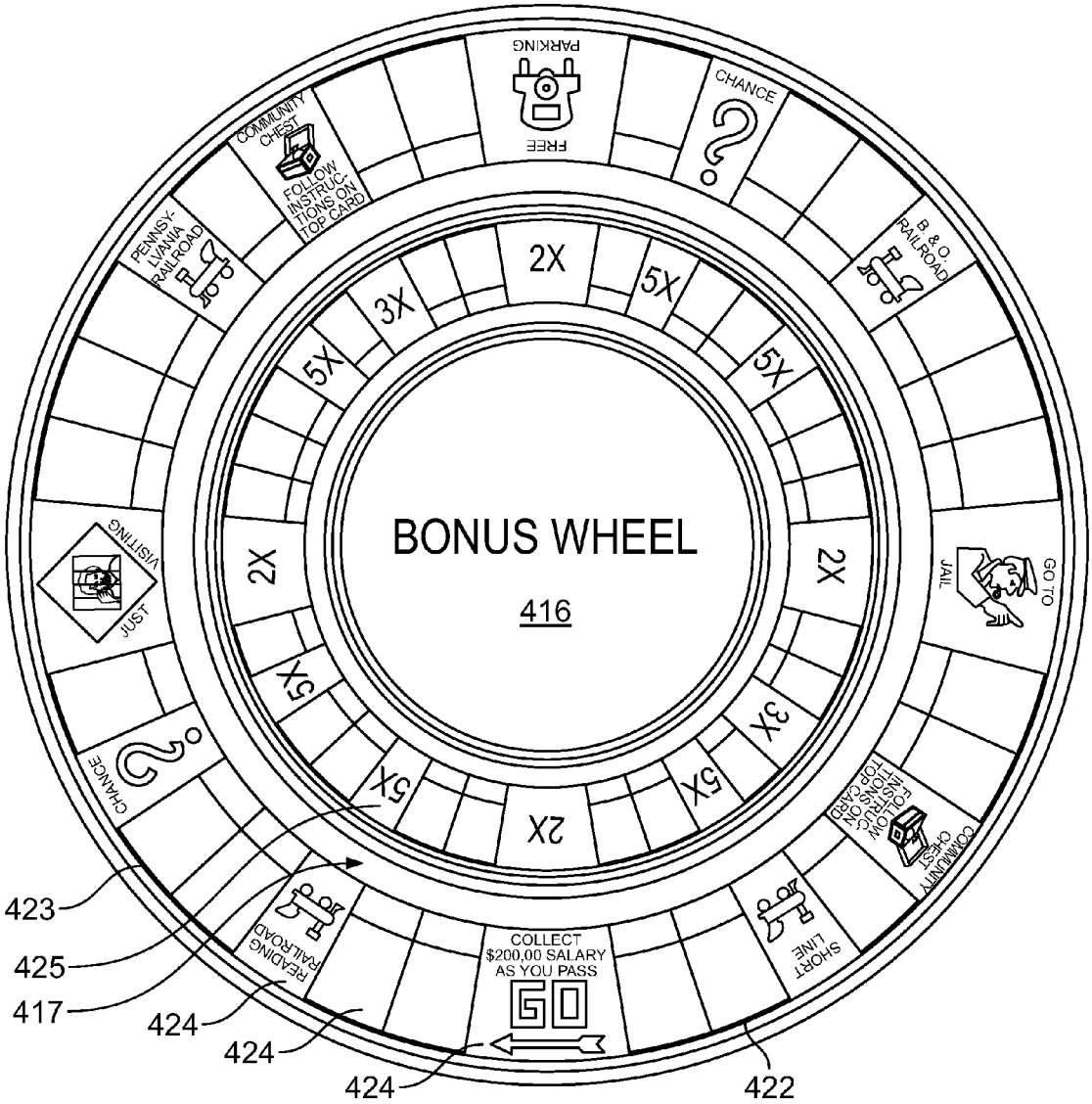
FIG. 10 is a top view of an image of a bonus game that may be projected onto the contoured surface of an embodiment of a gaming system with a table-game configuration.

Of course, the contoured surface 410 may include any number of contours 412 that correspond with corresponding structural features of a tangible object associated with a wagering game. As used herein, the term "tangible object" generally refers to a physical, or real, component, such as a piece of equipment. As shown in FIG. 4, the contours 412 of the contoured surface 410 include a substantially convex (from the player's perspective) surface 416 that is surrounded by the annular surface 414, which slopes upward and has a generally concave profile. This convex surface 416 resembles the dome-like central structure of a conventional roulette wheel, which slopes upwardly (from the player's perspective) as the structure extends radially inward. As shown in FIGS. 3 and 5, an image 417 associated with the MONOPOLY® theme, such as a logo, is projected onto the convex surface 416. However, any image or images 417 may be projected onto the convex surface 416. Indeed, as described further below, other games, such as a bonus game may be projected onto the convex surface 416. FIG. 10 illustrates a top view of an image 417 showing an example bonus game 425 that may be projected onto the convex surface 416 and the annular surface 414. In an embodiment, an animation may show a first image 417, such as the MONOPOLY® logo, dropping from the center of the roulette wheel 422 and a second image 417, such as the bonus game image, rising into the center of the roulette wheel 422 to replace the first image. The animation exploits the one or more contoured surfaces of the contoured surface 410 by depicting wagering-game images that appear to follow the contours, such as image elements that appear to slide off of the convex surface 416 or multipliers that have a larger value the closer they are to the center of the convex surface 416. In these aspects, the physical contour of the contoured surface 410 corresponds to the size, extent, intensity, immensity, largeness, proportion, volume, and the like of the wagering-game element being projected relative to the contoured surface 410.

In other aspects, the physical contour of the contoured surface 410 corresponds to movements made by or behavior associated with animated wagering-game elements that follow the contours of the surface 410. For example, wagering-game elements such as symbols, multipliers, and so forth, may be made to appear to "slide off" the center of the convex surface 416 toward the annular surface 414 just as a tangible object would if placed on the convex surface 416. In these aspects, the realism of the wagering game is preserved because the virtual wagering-game elements behave in a similar manner as they would as tangible objects in the physical world. For example, when the contoured surface 410 has a spiraled contour, wagering-game images can be animated to appear as if they are spiraling down the spiraled contour, gathering speed the farther they fall down the spiraled contour.

As shown in FIG. 4, due to the contours 412, different areas of the contoured surface 410 may be spaced at varying distances from the projector 450. As such, the focus range for the different areas may differ. Therefore, to minimize out-of-focus images that may result from the varying focus ranges, the images 420 may be pre-distorted by the controller to correct for the varying focus ranges for a single contoured surface 410. In this way, clear and focused images 420 appear on the contoured surface 410.

Additionally or alternately, pre-distortion of the images 420 to be projected by the projector 450 may be necessary to compensate for the contoured surfaces 414, 416 of the contoured surface 410. For example, an otherwise non-distorted image viewable on a flat surface is distorted to produce a barrel or pincushion distortion such that when displayed on a convex or concave contoured surface, respectively, the image appears not to be distorted as it follows the contour. An otherwise straight line that is distorted to produce barrel distortion would appear to be a straight line when applied to a convex-shaped contoured surface, such as the contoured surface 416.

Images may be stored as pre-distorted images in a memory, such as the system memory 36, or they may be distorted on-the-fly according to a distortion algorithm that receives as at least one input data indicative of the contour profile (e.g., whether the contour is convex, concave, slanting, etc., dimensions relevant to the contours, and so forth) of the surface on which the images will be projected.

Figure 6:
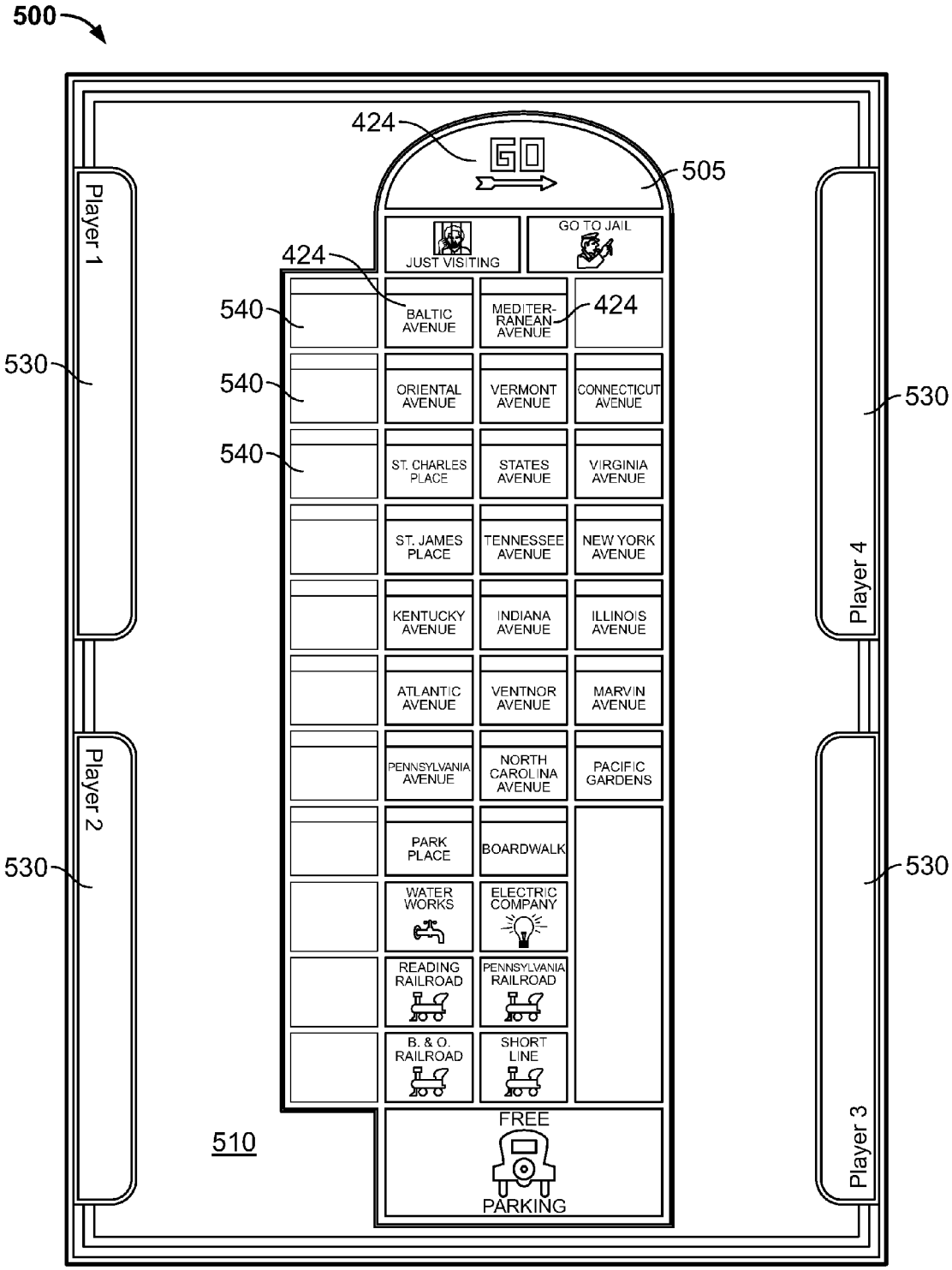
FIG. 6 is a top view of a projected image, in the embodiment of FIG. 3, representing a wagering grid.

The contoured surface 410 may be integrated with or into or formed with or from the tabletop 305 to define a single component as shown in FIGS. 3 and 4. Alternatively, the contoured surface 410 may be securely or removably positioned as a separate component on the tabletop 305, and the tabletop 305 may include registration members to receive contoured surfaces of varying shapes and sizes in a registered position. Advantageously, employing a separate contoured surface 410 that may be removably attached or positioned on the tabletop 305 permits a variety of contoured surfaces 410 corresponding to different versions or types of wagering games to be provided on the same tabletop 305. This interchangeability of the contoured surface 410 is not possible with traditional wagering games. For example, when the contoured surface 410 corresponds to a roulette wheel such as shown in FIGS. 3 and 5, an entirely different type of wagering game can be played on the tabletop 305 by removing the roulette wheel and positioning in its place a different contoured surface 410 corresponding to a different wagering game. The controller is programmed to execute other programmed instruction to generate images 420 that correspond to the new contoured surface 410. In such embodiments, the gaming system 300 may provide the flexibility of modifiable physical structures as well as changeable projected images 420. The flexible projector configurations of the gaming system 300, for example as illustrated in FIGS. 3 and 6, enable a variety of contoured surfaces 410 to be employed with a single tabletop 305. Advantageously, the gaming system 300 can provide varying physical structure even if the tabletop 305 and the table legs 307 are fixed in one place, for example, to the floor of a gaming establishment. Moreover, in contrast to cathode ray tubes, for instance, the distance and the shape of the surface 410 does not have to remain fixed with respect to the projector 450. In other words, cathode ray tubes are limited to using a surface with a standard shape at a fixed distance, whereas the contoured surfaces 410 of the gaming system 300 may employ any number and any type of contours 412.

As described previously with reference to FIG. 3, the tabletop 305 includes a wagering section 500 including a surface 510. As FIG. 6 shows in greater detail, the wagering section 500 includes player areas 530 as well as a wagering grid 505 including properties on which a player may place a wager. The player areas 530 provide spaces for participation by a plurality of players (up to 4 in the illustrated example). Meanwhile, the wagering grid 505 displays different possible wagers that may be placed on the outcomes determined in the outcome section 400. In addition, the wagering grid 505 is employed to receive wagers. For example, as with conventional table games, such as roulette, players may place chips which represent some monetary value directly on an area of the wagering area 505 to place a specific wager. As the outcome section 400 in the embodiment of FIG. 3 simulates the operation of a conventional roulette wagering game, the wagering area 520 correspondingly resembles a wagering grid for a conventional roulette wagering game. However, as described above, the embodiment of FIG. 3 employs a MONOPOLY® theme, where each outcome identifier 424 corresponds with a graphic element associated with the MONOPOLY® board game. Therefore, the wagering area 505 provides outcome identifiers 424 that correspond with graphic elements associated with the MONOPOLY® board game. As described further below, the wagering area 505 enables players to place a variety of wagers based on the random selection of these outcome identifiers 424.

Although the outcome section 400 includes a contoured surface 410, the cross-sectional view of FIG. 4 shows that the surface 510 of the wagering section 500 may be substantially planar and does not have to be a contoured surface. It is contemplated, however, that the surface 510 in other embodiments may also be contoured.

As further illustrated by the side cross-sectional view of FIG. 4, visual elements of the wagering section 500, including the wagering grid 505, are composed of images 520 that are projected by a projector 550 onto the surface 510. In general, however, any number of projectors 550 of sufficient power may be employed to form the images 520 on the surface 510. The projector 550, as shown in FIG. 4, is positioned at a selectable or adjustable distance above the surface 510 via an adjustable mechanism, and the visible light that forms the images 520 is transmitted downwardly onto the surface 510 where it is reflected upwardly to the eyes of players viewing the surface 510. To maximize reflection of the projected images 520, the surface 510 may include a white screen or other opaque or reflective material.

Alternatively, as shown in FIG. 7, the projector 550 is positioned at a selectable or adjustable distance below the surface 510 via an adjustable mechanism, and the visible light that forms the images 520 is transmitted upwardly to the surface 510. To permit the projected image 520 to be viewed from the upper surface 310, the surface 510 may be a substantially transparent substrate that permits images 520 to be passed through the surface 510 and displayed to people viewing the surface 510.

Although FIGS. 4 and 7 may show that the projector 550 is oriented vertically to permit immediate transmission of light to the surface 510, as discussed above, it is understood that the projector 550 may have other orientations, and where necessary, intermediate optical devices, such as mirrors or lenses, may be employed to focus or redirect the light to the surface 510.

Although the surface 510 may be substantially blank to receive and display the projected images 520, some visual elements may be more permanently applied, rather than projected, to the surface 510. In such embodiments, these applied images are displayed in combination with the projected images 520. Indeed, in some embodiments, no images are projected onto the surface 510 and all visual elements, including the wagering area 505, may be more permanently applied to the surface 510. However, as described above, the use of projected images provides unpredictable advantages. In particular, the visual appeal and entertainment value of video images may promote the popularity of the gaming system 300. Additionally, the use of projected images facilitates the implementation of changes to the gaming system 300. Such changes may be employed to provide aesthetic variety or to change aspects of the game play. For example, the possible wagers available through the wagering area 505 may be changed.

In some embodiments, the surface 510 may employ sensing devices, such as multipoint sensing devices, to determine wagering and/or other input activity by multiple players simultaneously in the wagering area 505 as well as the player regions 530. The data from these sensing devices, for example, may be processed by the controller 34 to respond to the players actions by altering the images 420 and/or 520. For instance, as described previously, aspects of the roulette wheel image 422 may be changed dynamically according to the types and amount of wagering by the players. The multipoint sensing device may be any suitable multipoint touchscreen capable of detecting or sensing multiple points touched simultaneously on the surface 510 or multiple gestures gestured over the surface 510. An example of suitable multipoint sensing devices includes a multipoint touchscreen available from CAD Center Corp. under the trade designation "NEXTRAX™." This multipoint touchscreen is an optical-based device that triangulates the touched coordinate(s) using infrared rays (retroreflective system) or an image sensor. Another example is a frustrated total internal reflection (FTIR) device, such as developed by the Media Research Laboratory at New York University's Department of Computer Science, and described in Jefferson Y. Han, Low-Cost Multi-Touch Sensing Through Frustrated Total Internal Reflection (Proceedings of the 18th Annual ACM Symposium on User Interface Software and Technology 2005), at 115-118. A device suitable as a multipoint sensing device in accordance with aspects described herein is the "Entertaible" developed by Philips Research, which uses a series of infrared LEDs and photodiodes mounted around the perimeter of an LCD display. A still further example of a multipoint sensing device is a transparent self-capacitance or mutual-capacitance touchscreen, such as described and shown in WO 2005/114369, entitled "Multipoint Touchscreen," which claims priority to U.S. patent application Ser. No. 10/840,862, and is assigned to Apple Computer, Inc. Another suitable contact sensing device in accordance with aspects herein is the Diamond Touch Table offered by Mitsubishi Electric Research Laboratories. Still another suitable contact sensing device in accordance with aspects herein is the multi-zone five-wire touchscreen offered by GM Nameplate, Inc. and developed in conjunction with TouchKO, which allows up to four input zones on a single screen, and all four touches may occur simultaneously, leading to four distinct inputs.

Figure 8:
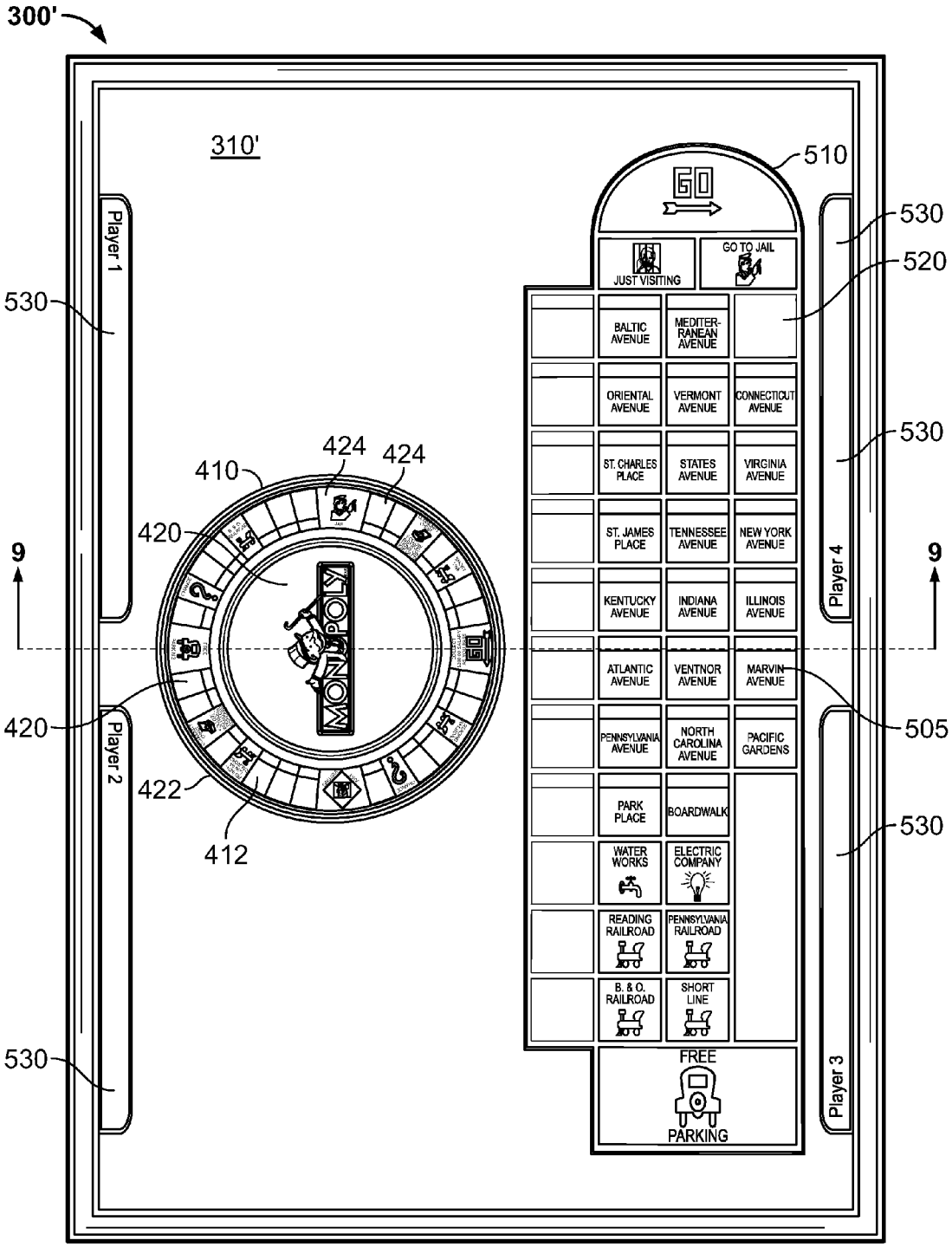
FIG. 8 is a top view of a further embodiment of a gaming system with a table-game configuration.
Figure 9:
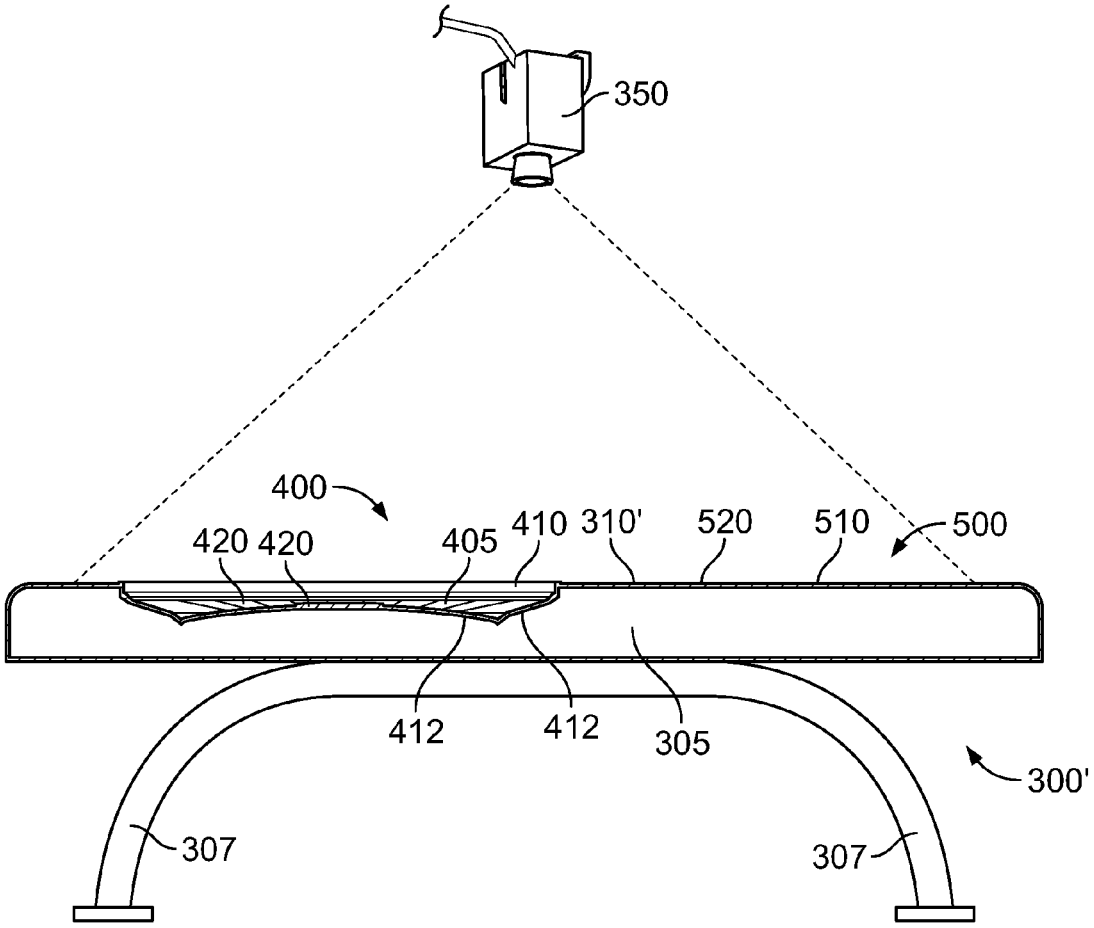
FIG. 9 is a side cross-sectional view of the embodiment of FIG. 8.

Although FIG. 3 illustrates an outcome section 400 that is separate from the wagering section 500, other aspects are capable of alternative configurations. For example, FIG. 8 illustrates a top view of gaming system 300' with a single integrated surface 310' that includes both a contoured surface 412 for receiving images 420 representing a roulette wheel 422 and a planar, non-contoured surface 510 for receiving images 520 representing a wagering grid 505. FIG. 9 illustrates a side cross-sectional view of the gaming system 300' with the cross-section taken as indicated in FIG. 8. As shown in FIG. 9, the images 420 and the images 520 are projected onto the surface 310' by a single projector 350, rather than two projectors. Although the projector 350, as shown in FIG. 9, may be project the images 420 and 520 downwardly from above the surface 310', it is contemplated that the projector 350 may be positioned below the surface 310' to project the images 420 and 520 upwardly through the surface 310' as similarly described with reference to FIG. 6. In an aspect, the configuration of FIG. 8 may be more compact than that of FIG. 3. In other respects, however, the example of FIG. 8 is generally similar to that of FIG. 3.

As discussed above with reference to FIG. 3, the wagering grid 505 displays different possible wagers that may be placed on the outcomes displayed in the outcome section 400. As shown in FIG. 5, the wagering grid 505 includes images of outcome identifiers 424 associated with a MONOPOLY® theme. As such, the outcome identifiers 424 may correspond with twenty-two streets, divided into eight color groups of two or three streets, four railways/stations, two utilities, "GO," "JUST VISITING," "GO TO JAIL," and "FREE PARKING." A player may simply wager that one of these outcome identifiers 424 will be selected by a single simulated spin of the roulette wheel 422. The wagering grid 505 may also organize the outcome identifiers 424 into groups 540. For example, FIG. 5 includes groups that organize the twenty-two streets according to the eight colors. Thus, a player may place a wager, with higher odds but lower payout, that an outcome identifier 424 belonging to one of the groups will be the outcome of a single simulated spin.

A player may place side wagers against other players. Some of these side wagers may be based on the outcomes from a series of simulated spins. For example, players may each wager on a group 540, and a winner is declared when all outcome identifiers 424 belonging to one of the groups 540 is selected.

Furthermore, a progressive jackpot may be established. For instance, there are no winners when the selected outcome identifier 424 on the roulette wheel 422 is "INCOME TAX" or "LUXURY TAX." Instead, the wagers are placed into a progressive jackpot that is awarded when a player wins based on a wager placed on "FREE PARKING."

In addition, bonus awards or bonus game play may be provided. For example, when the selected outcome identifier 424 on the roulette wheel 422 is "COMMUNITY CHEST" or "CHANCE," a bonus wheel 425 may appear in the center of the roulette wheel 422, and the outcome of the simulated spin of the bonus wheel 425 may determine a bonus award that affects all players. Bonus awards, for instance, may include award multipliers. It is understood that the images for a bonus game may also be displayed on other areas of the surface 310, 310', such as the surface 510 of the wagering section 500.

Although several examples of possible wagers are provided herein, it is understood that the gaming system 300, 300' is not limited to these examples. Given the flexibility of the gaming system 300, 300', new features, including new wagering possibilities, may be easily implemented.

Figure 11:
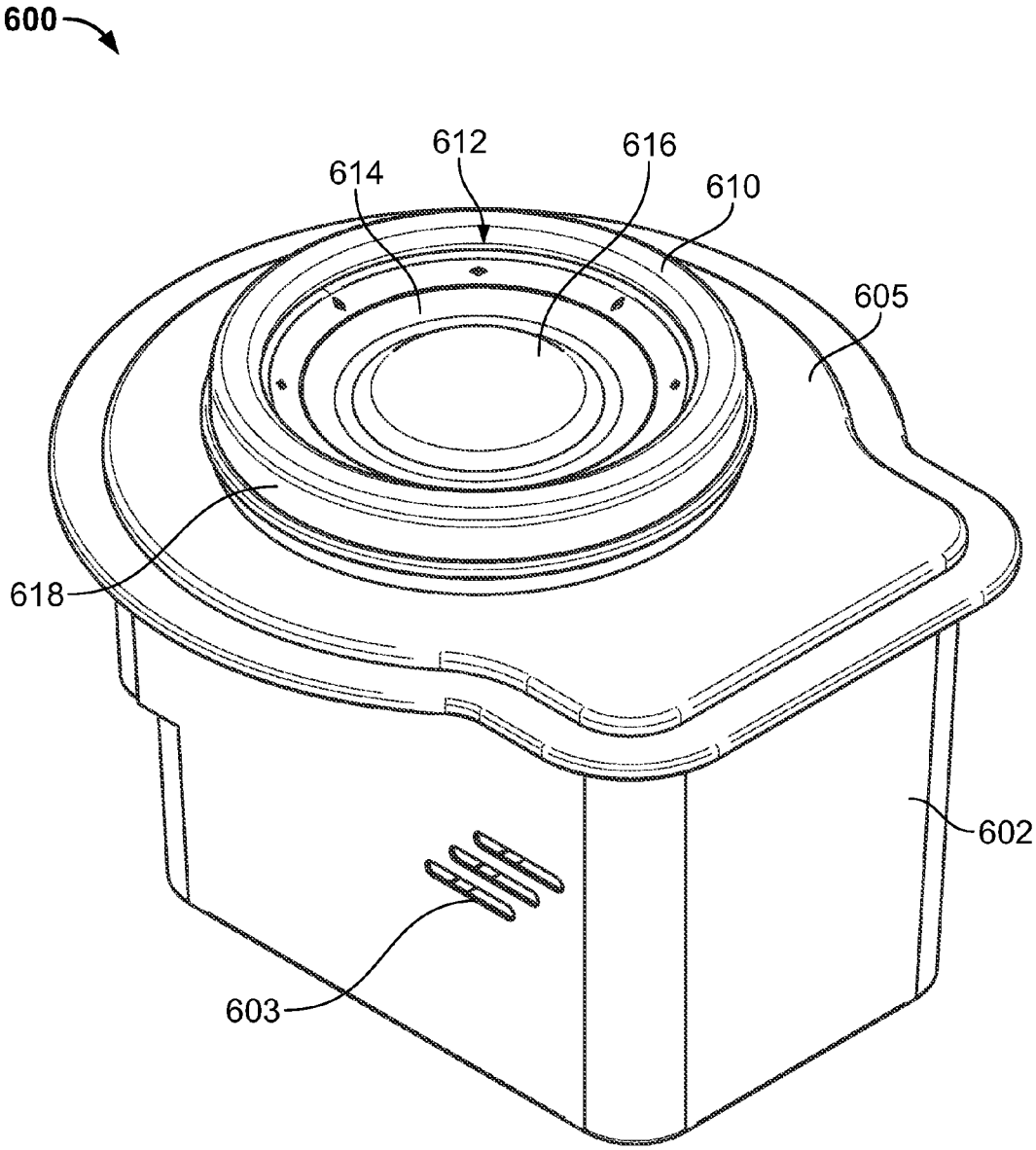
FIG. 11 is a perspective view of yet another embodiment of a gaming system with a table-game configuration.

Referring to FIG. 11, other aspects of the present invention are illustrated in a gaming system 600. Similar to other embodiments described herein, the gaming system 600 includes a base cabinet 602 with a table top 605. The table top 605 include a surface 610 that is contoured to simulate the shape of a roulette wheel and receive projected images corresponding to a roulette wagering game. As shown in FIG. 11, unlike some embodiments described previously, the gaming system 600 may be provided without a wagering section on the table-top. Rather, the gaming system 600 may act as a standalone roulette table that can be positioned next to a separate multi-touch table, a slant top gaming machine, or the like, which provides corresponding wagering game functions, such as a wagering grid, for the standalone roulette table. Employing appropriate dimensions, the gaming system 600 may also provide a table around which barstools can be arranged for players who use handheld gaming devices to place wagers on the wagering game. The use of handheld gaming devices is described in further detail below.

To enhance the visual appeal of the gaming system 600, the surface 610 may include a section that physically moves relative to other sections of the contoured surface 610. In addition to providing shapes that simulate a conventional roulette wheel, the gaming system 600 also simulates the operation of moving parts of a conventional roulette wheel. For example, the contoured surface 610 may include a section that physically moves to simulate movement of the pockets and corresponding outcome identifiers of a conventional roulette wheel. Although the gaming system 600 may provide further realism and may be very similar to a conventional roulette wheel, the gaming system 600 provides features that are not available with a conventional roulette wheel. For example, as described previously, the video and graphics that are electronically projected onto the contoured surface allow the gaming system 600 to be quickly and easily changed to a selected visual theme or type of game. For example, the gaming system 600 may change from a traditional roulette game to a MONOPOLY® theme. Moreover, the gaming system 600 may include visual and graphic elements that are not possible with a conventional roulette wheel. For example, in the MONOPOLY® theme, animation may show Mr. Monopoly chasing the image of the roulette ball as it seeks to land in a property pocket.

Figure 13:
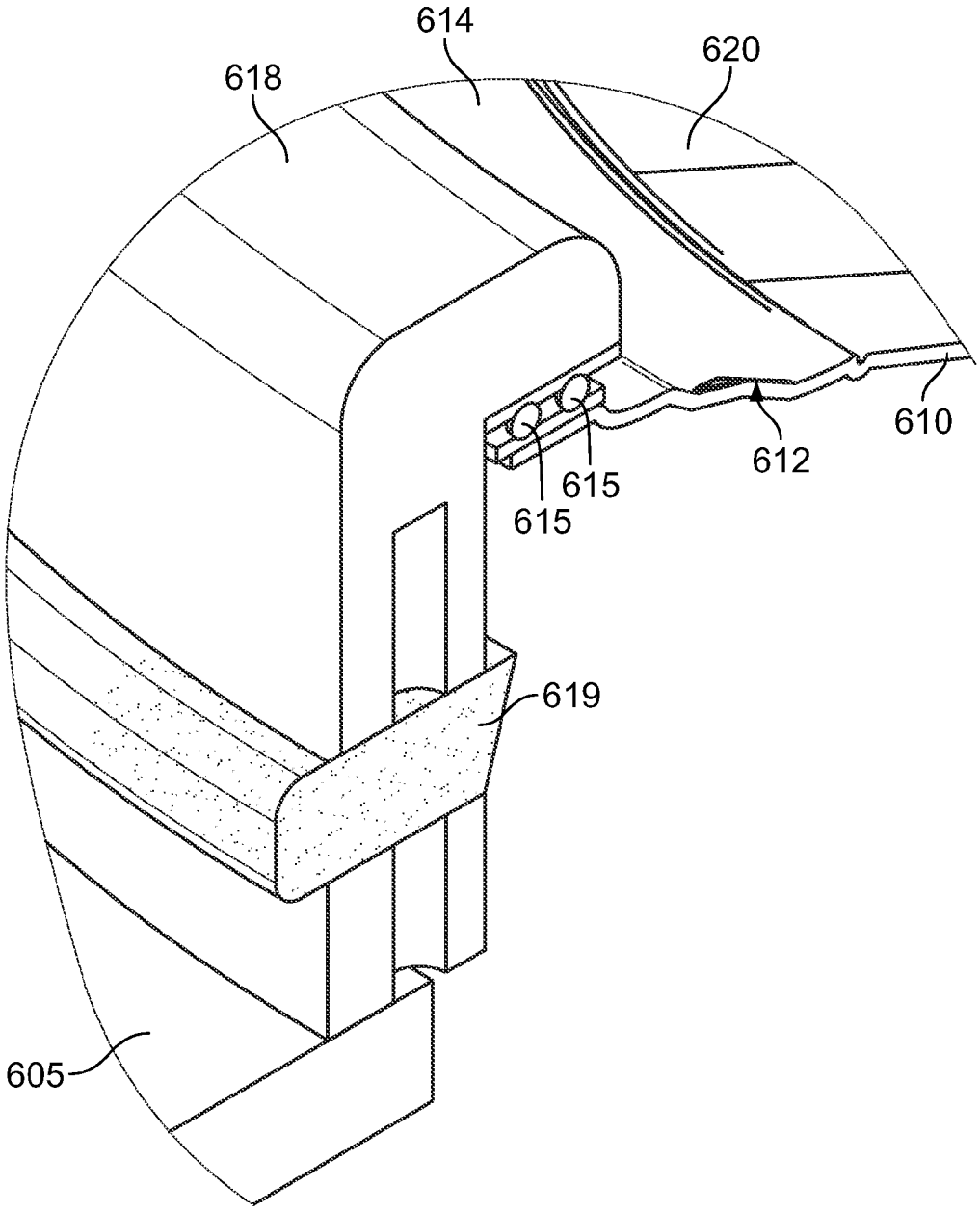
FIG. 13 is a cut-away view of a guiding structure for a moving section of the embodiment of FIG. 11.

As shown in FIG. 11, the contours 612 of the surface 610 include at least a substantially convex surface 616 that is surrounded by an annular surface, or ring, 614 that slopes upwardly to an outer perimeter 618. The annular surface 614 may correspond with the section of a roulette wheel where the pockets and corresponding outcome identifiers are positioned. In one embodiment, the convex surface 616 and the outer boundary 618 may remain stationary while the annular surface 614 may physically rotate around the convex surface 616 to simulate the rotation of the pockets and corresponding outcome identifiers. As shown in FIG. 13, movement of the annular surface 614 relative to other sections, such as the outer ring 618, may require a guiding structure 615, such as ball bearings, a track system, or a like mechanism that provides the appropriate amount of support for the movement.

Figure 14:
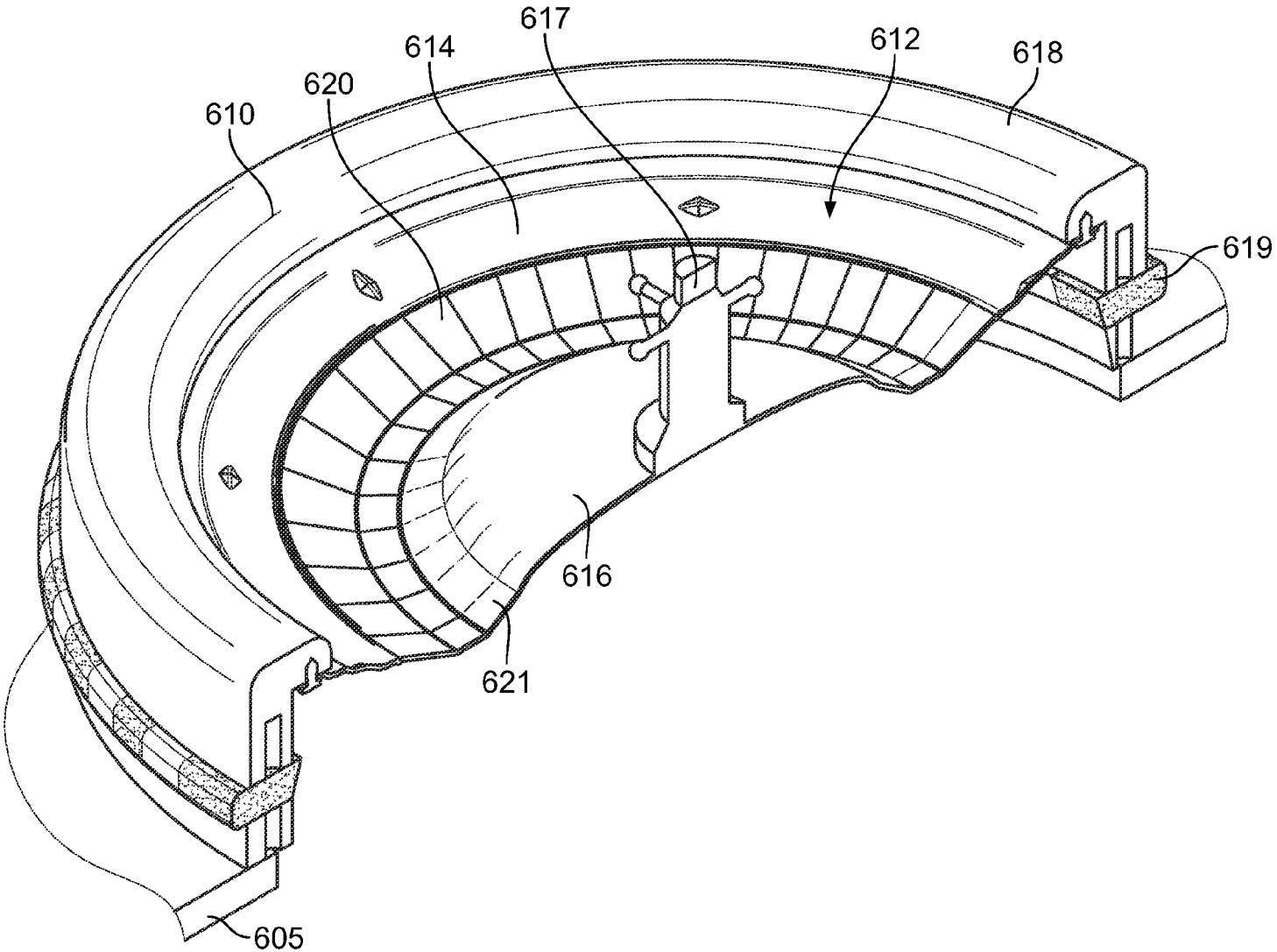
FIG. 14 is a cut-away view of a contoured display surface of the embodiment of FIG. 11.

Embodiments are not limited to having a physically rotating annular surface 614. Other parts of the gaming system 600 may also be capable of physical movement, including rotational and/or lateral movement. In alternative embodiments, the convex section 616 and/or the outer perimeter 618 may also rotate physically at different speeds or in opposite directions. Furthermore, as shown in FIG. 14, the gaming system 600 may include a cross piece 617, similar to those typically found in the center of a roulette wheel. In particular, the cross piece 617 is positioned in the center of the convex surface 616 and may rotate in concert with the annular surface 614, for example, via an electromechanical coupling. The rotation of the cross piece 617 corresponds with and also highlights the movement of the annular surface 614. In these embodiments, the convex surface 616 may remain stationary or may also rotate with the cross piece 617.

Figure 12A:
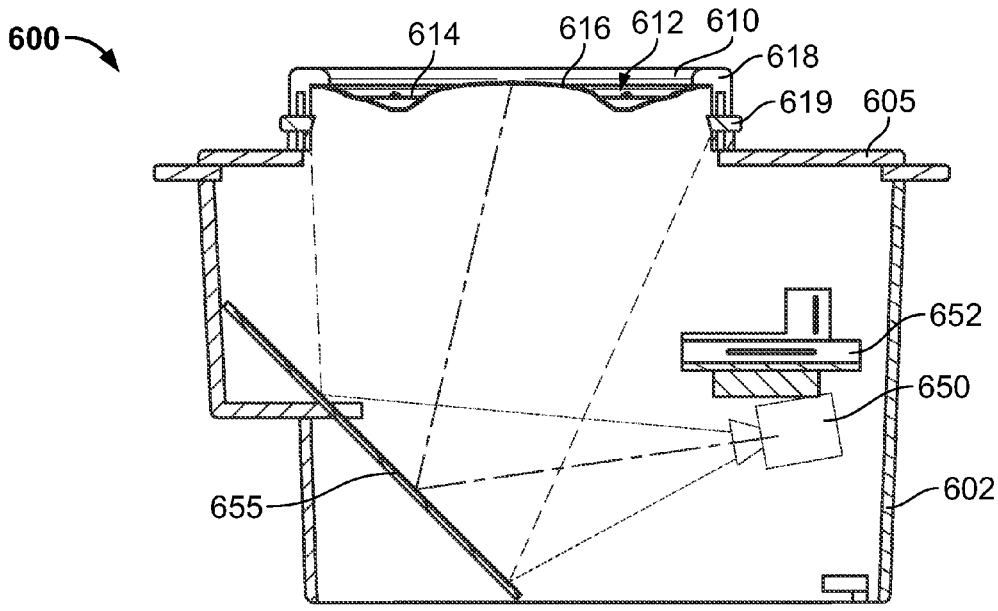
FIG. 12A is a side cross-sectional view of the embodiment of FIG. 11.
Figure 12B:
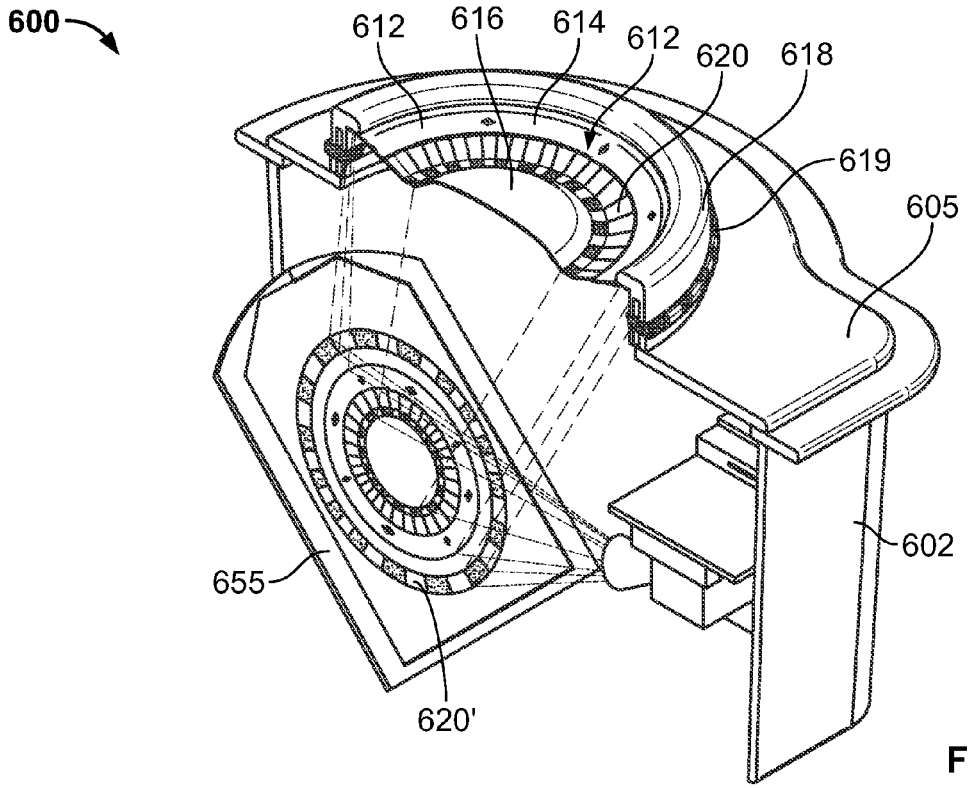
FIG. 12B is a cut-away view of the embodiment of FIG. 11.

As shown in FIGS. 12A-B, the gaming system 600 may include a projector 650 that is positioned to project images 620 onto the contoured surface 610 from beneath the contoured surface 610. As such, the projector 650 is disposed within the base cabinet 602. The base cabinet 602 may provide a heat vent 603 as shown in FIG. 11 to allow some of the heat generated from the projector 650 to escape the interior of the base cabinet 602. In addition, the projector 650 may be mounted on an adjustable slide mount 652 so that it can be adjusted in multiple degrees of freedom for proper zoom, focus, etc.

As FIGS. 12A-B further illustrate, the gaming system 600 may employ at least one mirror 655 to form the images 620 on the contoured surface 610. FIG. 12B shows that the projector 650 delivers images 620' directly to the mirror 655, and the images 620' are reflected to the contoured surface 610 to form the images 620. As described previously, aspects of the projected images may be pre-distorted to account for the varying contours of the contoured surface and the varying focal lengths between the projector and different sections of the contoured surface. Accordingly, the gaming system 600 may pre-distort aspects of the images 620. However, the gaming system 600 may also take into account how the light from the projector 650 is reflected from the mirror 655. The reflection, for example, depends at least on the angles that the surface of the mirror 655 makes with the light beam. As shown in FIG. 12B, the position and angle of the minor 655 relative to the projector 650 may cause the reflected images 620' at the mirror 655 to be elongated or distorted. For example, a circular image from the projector 650 becomes an ellipse at the mirror 655. However, any changes caused by the mirror 655 can be predicted and where necessary can be corrected by pre-distortion to form the desired images 620 at the contoured surface 610. The use of minors, lenses, and/or any other suitable optical devices may be particularly advantageous when the gaming system must be compact and there is insufficient space to permit images to be projected directly to the contoured surface. Although the minor 655 shown in FIGS. 12A-B, may be appear to be planar, it is understood that any number, types, and/or shapes of optical devices may be employed to direct and/or manipulate the light from the projector 650. For example, in some embodiments, a specially shaped mirror may be employed to change the type or amount of pre-distortion required to form the desired images 620 on the contoured surface 610.

A controller, as discussed previously, may synchronize the projection of some images 620, such as images of pockets and outcome identifiers, onto the annular surface 614 with the physical rotation of the annular surface 614. In other words, animated images may be projected onto the annular surface 614 to substantially follow the rotation of the annular surface 614, so that the images remain static relative to the annular surface 614. Therefore, as the rotation of annular surface 614 increases or decreases, the controller maintains the synchronization between the images 620 and the annular surface 614.

In one embodiment, the controller may control movement of the annular surface 614 via an encoder wheel or synchronous motor to synchronize the annular surface 614 with the animated images of the pockets and the outcome identifiers. A technique for synchronizing a spinning object with video animation is described in U.S. application Ser. No. 11/937,740 to Rasmussen et al., filed Nov. 9, 2007, and titled "WAGERING GAME WITH SIMULATED MECHANICAL REELS HAVING AN OVERLYING IMAGE DISPLAY," the contents of which are entirely incorporated herein by reference.

Alternatively, sensors may be employed to detect the motion of the annular surface 614 and send signals to the controller. In response, the controller can send synchronized images 620 via the projector 650. In some embodiments, game play can be initiated by the manual operation of the annular surface 614, e.g., via a croupier, similar to a conventional roulette wheel. The images 620 are then projected on the annular surface 614 according to the manual and natural mechanical rotation of annular surface 614, including any increase or decrease in the speed of rotation.

Other animated images 620, such as an image of the roulette ball, may be projected onto the annular surface 614 so that they appear to be moving relative to the annular surface 614 as the annular surface 614 rotates. For example, during game play, images of pockets and outcome identifiers rotate in concert with the annular surface 614, while an animated image of the roulette ball bounces along the annular surface 614 in varying directions and speeds, similar to the random movement of a physical roulette ball on a spinning roulette wheel. In some cases, the image of the roulette ball may appear to bounce outside the rotating annular surface 614 to another part of the contoured surface 610. Although the image of the roulette ball may move relative to the annular surface 614, the animation for the roulette ball may depend on the rotation of the annular surface 614. For example, in response to the slowing in the rotation of the annular surface 614, the animation may show a corresponding slowing of the image of the roulette ball. Eventually, the image of the roulette ball may settle in an image of a pocket to identify an outcome to the game, and at this point, the image of the roulette ball moves in synchronization with the annular surface 614 if the annular surface 614 is still rotating. Accordingly, the controller may coordinate aspects of the images of pockets and outcome identifiers as well as the roulette ball with the rotation of the annular surface 614. As described previously, three-dimensional mathematical models may be employed to simulate the real-world motion of a roulette ball on a spinning roulette wheel.

In general, the images 620 projected on other sections of the contoured surface 610 may be static or animated regard-less of whether the sections are stationary or physically move. For example, the convex surface 616 may be stationary and may receive both static images and animated images. As shown in FIG. 14, even if the primary image on the convex surface 616 is intended to be static, parts of the convex surface 616 may receive animated images 621 that simulate light reflected from the moving pockets and/or the outcome identifiers projected on the annular surface 614. The animated images 621 further highlight the movement of the annular surface 614 and add to the realism of the gaming system 600.

As also shown in FIG. 14, the outer perimeter 618 of the contoured surface 610 may include an outer ring 619 that can be illuminated with light from the projector 650. For example, the outer ring 619 may be formed from acrylic. As shown in FIG. 12A, the acrylic ring 619 may have a polished side that is angled to receive light from the projector 650, so that the light can be diffused through the acrylic ring 619 like a prism. In particular, the polished surface may be presented at a 45-degree angle relative to the direction of projected light. The light hits the 45-angled surface and scatters inside the acrylic, thereby illuminating the ring 619 to the outside observer. This technique eliminates the need for a separate light pipe or lighting element to light up the ring or to provide similar visual effects. This illuminated outer ring 619 provides yet another visual effect or accent that may attract players and heighten excitement. Accordingly, the projector 650 not only supplies the video images on the wheel, but also acts as a light source for illuminated visual effects. In some embodiments, the projector 650 may also project animated video, colors, or other images onto the ring.

Some embodiments employ handheld, or personal, gaming devices for entering wagers. Such handheld gaming devices may be used by additional players when the player areas at the wagering section are already occupied. Additionally or alternatively, the handheld gaming devices may be employed to enable more complex wagers, such as those which cannot be entered through, or tracked, by a wagering grid. For example, as described above, wagers may be based on the outcomes of a series of spins of the roulette wheel image. The handheld devices can be employed for entering and tracking such wagers. Using wired or wireless communications, the handheld devices may be networked with each other as well as the controller. Communication between handheld gaming devices enable side bets to be placed between players. The reprogrammable nature of the handheld gaming devices enables new or different types of wagers to be employed, providing more variety and entertainment for players.

Figure 15:
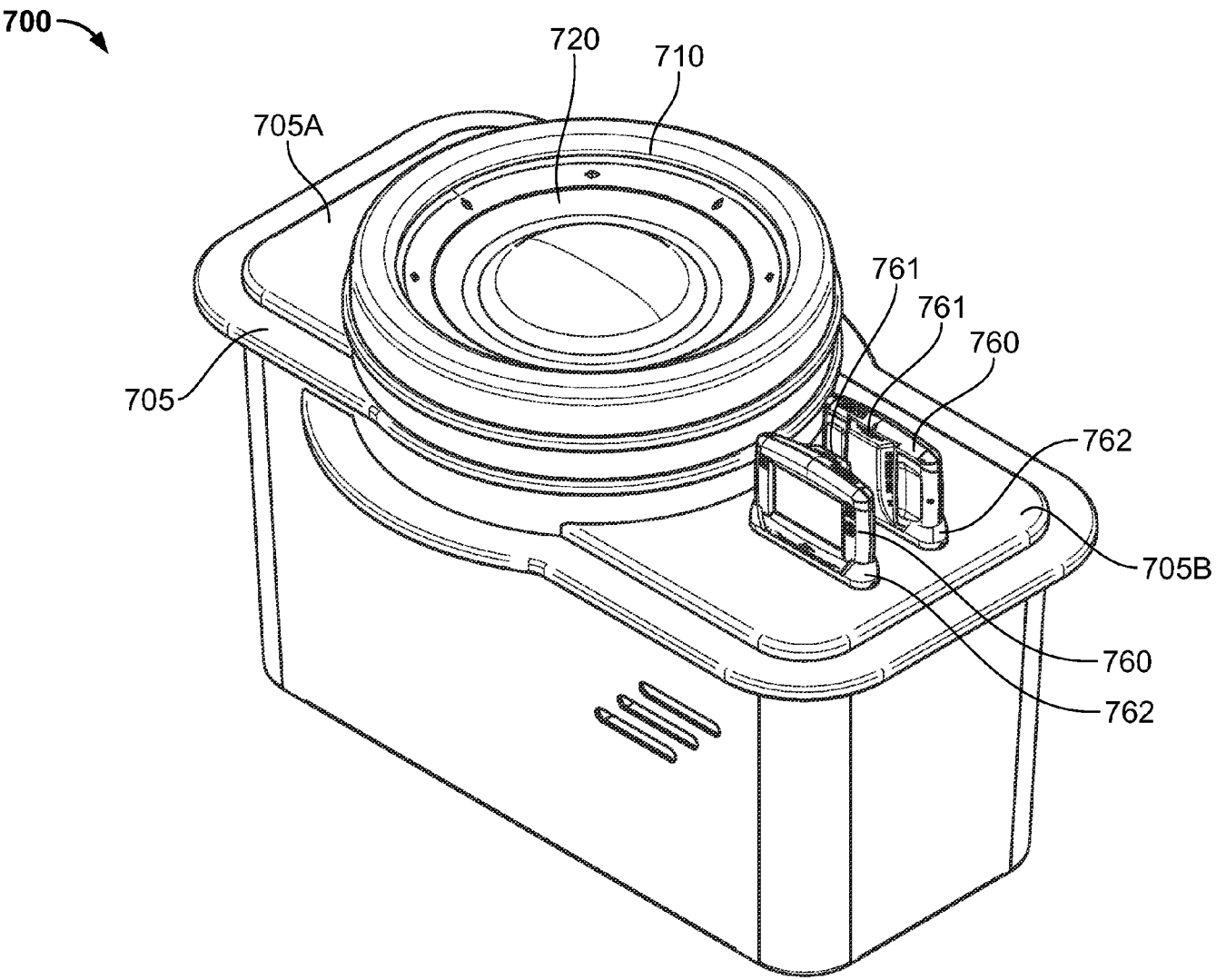
FIG. 15 is a perspective view of a further embodiment of a gaming system with a table-game configuration.
Figure 16:
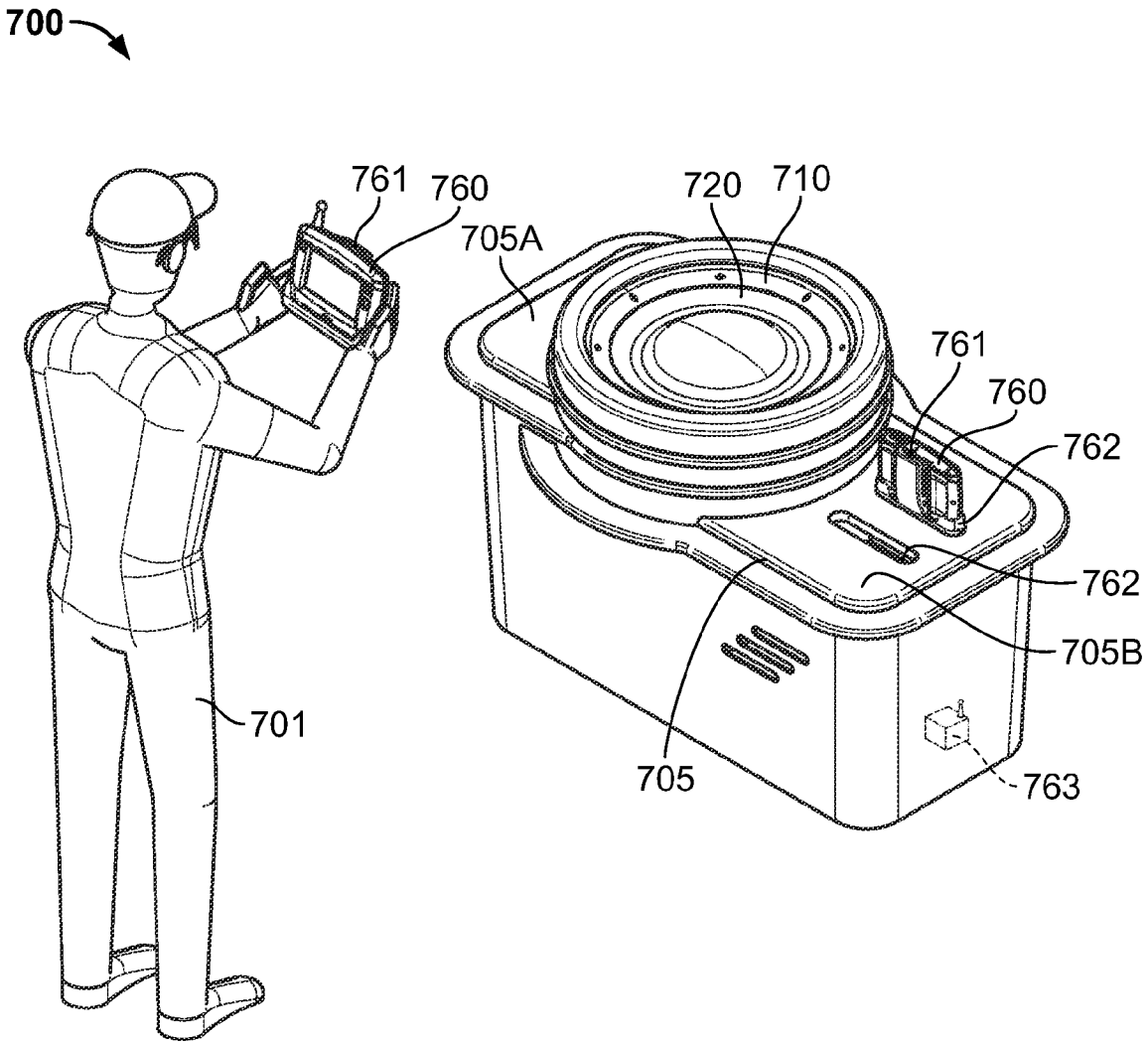
FIG. 16 is a perspective view of the embodiment of FIG. 15 in operation.

Referring to FIGS. 15-16, a gaming system 700 employing handheld gaming devices is illustrated. The gaming system 700 is similar to the other gaming systems described herein and employs a contoured surface 710 that receives video images from a projector and has a shape corresponding to physical aspects of a roulette wagering game. Unlike some embodiments described previously, however, the gaming system 700 may be provided without a wagering section on the table-top. Instead, a player 701, as shown in FIG. 16, may employ a handheld gaming device 760 to place wagers for the gaming system 700, and the result of a game is displayed via the images projected on the contoured surface 710. For example, a wagering grid, such as those described previously, may be provided through the handheld gaming devices 760 rather than a wagering section on a table-top section.

As shown in FIG. 15, a table top 705 on a base cabinet 702 of the gaming system 700 has a section 705A that includes the contoured surface 710. The table top 705 also has a section 705B that includes a plurality of docking cradles 762 that receive a plurality of handheld gaming devices 760, especially when the handheld gaming machines 760 are not in use by players 701. When placed in the docking cradles 762, the handheld gaming devices 760 may, for example, be recharged with more power, may receive software updates, and/or may communicate data with the gaming system 700.

As further illustrated by FIG. 15, the sections 705A and 705B may be may be set at different levels. Indeed, the gaming system 700 demonstrates that the table top 705 may have multiple sections at varying levels. These different configurations provide aesthetic variety as well as functional advantages. For example, the section 705A is higher than the section 705B. In one aspect, the contoured section 710 is raised on 705A to draw attention to, and make more visible, the projected images 720 and the operation of the wagering game. In addition, the section 705B is situated at a lower level so that the handheld gaming machines 760 do not obstruct the visibility of the projected images 720 or interfere with the operation of the wagering game. In particular, the lower section 705B is situated so that, when placed in the docking cradles 762, the tops of the handheld wagering devices 760 are below the top of the contoured surface 710 on the higher section 705A.

In operation, one of the players 701 may take one of the handheld gaming devices 760 docked in one of the cradles 762, or may alternatively approach the gaming system 700 with a handheld gaming device 760 already in hand. The player 701 may place his player card into an input 761 in the handheld gaming device 760. The player 701 may also be required to enter identifying information, such as a personal identification number (PIN) or password, to authenticate himself. A remote account for player 701 may then be electronically accessed wirelessly by the handheld gaming device 760, and a remote account server may determine whether the player has sufficient funds to play the wagering game. A networked wireless receiver/transmitter for communicating with the handheld gaming device 760 may be located, for example, within the base cabinet 702. The player places wagers using the handheld gaming device 760, and the appropriate funds are deducted automatically from the player's remote account. The game outcome is then displayed on the contoured surface 710 as described previously. To cash out any awards based on the game outcome, the player may execute a corresponding function on the handheld wagering device 760. When the player 701 is finished playing at the gaming system 700, the handheld wagering device 760 may prompt the player to remove his player card and return the handheld wagering device 760 to one of the cradles 762.

Although the embodiments discussed above may employ projectors 450, 550 and 650, alternative embodiments may employ other techniques or devices for providing video images on the contoured surface. The images may, for instance, be transmitted from the contoured surface itself, so that a projector is not needed to reflect images off, or transmit images through, a display surface. For example, multi-colored electronic paper (electrophoretic paper), OLED's, and other flexible display technologies are emerging and, as such technologies are further developed, may be shaped to create contoured surfaces and may be driven by a controller to display images associated with wagering games. In some embodiments, a plurality of individual displays is employed in combination to create the complete playing surface. For example, to generate a roulette wheel image in a particular embodiment, a first display may be used to provide images for the outcome identifiers arranged about a contoured periphery while a second display is used to provide images for the dome-like central structure.

Each of these embodiments and obvious variations thereof is contemplated as falling within the spirit and scope of the claimed invention, which is set forth in the following claims.

What is claimed is:

1. A gaming system comprising:

a projector configured to project video images associated with a tangible object including structural features related to a wagering game;

a contoured display surface positioned to receive the video images from the projector, the contoured display surface including one or more contours that correspond to the structural features of the tangible object, the contoured display surface and the video images combining to simulate the tangible object; and a controller in communication with the projector, the controller being programmed to cause the projector to project the video images relative to the contoured display surface, the video images at least partially depicting a randomly selected outcome of the wagering game.

2. The gaming system according to claim 1, wherein the contoured display surface includes a plurality of contours.

3. The gaming system according to claim 1, wherein the video images are pre-distorted before the contoured display surface receives the video images.

4. The gaming system according to claim 1, further comprising a table, wherein the contoured display surface is removably attached to the table, a top surface of the table being configured to receive one of a plurality of differently shaped contoured display surfaces.

5. The gaming system according to claim 1, wherein the video images represent physical changes to the tangible object while the contoured display surface remains unchanged.

6. The gaming system according to claim 1, wherein the video images received by the contoured display surface represent a roulette wheel having a plurality of outcome identifiers arranged about a periphery of the roulette wheel, each outcome identifier corresponding to a randomly selected outcome in the wagering game, the wagering game being roulette.

7. The gaming system according to claim 6, wherein, to indicate the randomly selected outcome of the wagering game, the video images represent a spinning motion of the roulette wheel and a roulette ball landing on one of the outcome identifiers.

8. The gaming system according to claim 7, wherein the contoured surface includes an annular surface that slopes upward as the annular surface extends radially outward, the annular surface receiving the video images of the outcome identifiers.

9. The gaming system according to claim 8, wherein the contoured display surface further includes a substantially convex surface within the annular ring.

10. The gaming system according to claim 9, wherein a bonus game is projected onto the substantially convex surface by the projector.

11. The gaming system according to claim 6, further comprising a non-contoured display surface displaying an image of a wagering grid, the wagering grid portraying a plurality of available wagers associated with the wagering game.

12. The gaming system according to claim 11, wherein the non-contoured display surface includes a multipoint sensing device for sensing at least two distinct contact points simultaneously, the multipoint sensing device receiving inputs indicative of wagers placed via the wagering grid.

13. The gaming system according to claim 1, wherein the controller executes a real-world simulation algorithm in connection with the randomly selected outcome of the wagering game.

14. The gaming system according to claim 1, wherein the projector is coupled to an adjustable mechanism for adjusting the projector's distance above the contoured display surface and projects the video images downwardly to the contoured display surface.

15. The gaming system according to claim 1, wherein the projector is positioned an adjustable distance below the contoured display surface and projects the video images upwardly to the contoured display surface, the contoured display surface passing the video images to a top surface of the contoured display surface to enable players to view the video images from above the contoured display surface.

16. The gaming system according to claim 1, further comprising at least one networked personal gaming device that receives wagers for the wagering game from a player.

17. The gaming system according to claim 16, further comprising:

at least one docking station for receiving the at least one personal gaming device; and a multi-level gaming table including a first level and a second level, the first level including the contoured display surface, the second level including the at least one docking station, the first level being higher than the second level.

18. A gaming system comprising:

a projector;

a contoured display surface separated from the projector and positioned a distance from the projector that can be varied, the projector projecting video images through the contoured display surface or reflecting the video images off of the contoured display surface such that the video images are viewable relative to the contoured display surface, the video images representing a tangible object related to a theme of a wagering game, the contoured display surface including one or more contours that correspond to the structural features of the tangible object, the contoured display surface and the video images combining to simulate the tangible object; and a controller operatively coupled to the projector, the controller programmed to cause the projector to project the video images toward the contoured display surface at least as a function of the distance between the projector and the contoured display surface, the video images at least partially depicting a randomly selected outcome of the wagering game.

19. The gaming system of claim 18, further comprising a memory for storing the video images, the video images being pre-distorted in the memory to compensate for distortion that occurs when the video images are projected through or off of the contoured display surface.

20. The gaming system of claim 19, wherein the contoured display surface includes a first contoured portion and a second contoured portion that is contoured differently from the first contoured portion.

21. The gaming system according to claim 20, wherein at least one of the video images received by the contoured display surface represents a roulette wheel, and the first contoured portion comprises a substantially convex surface surrounded by the second contoured portion, which includes an annular surface that slopes upward as the annular surface extends radially outward away from the convex surface.

22. The gaming system of claim 20, wherein the video images include an animation of a sequence of images related to the bonus game that appear to grow or shrink in size, the controller being further programmed to cause the projector to project the animation relative to the contoured display surface such that as the sequence of images appears to grow or shrink in size, the contoured profile of the contoured display surface enhances the appearance of growth or shrinkage of the sequence of images.

23. A gaming system comprising:

a projector configured to project video images representing a tangible object related to a wagering game;

a display surface positioned to receive the video images from the projector, the display surface having at least one moving section that moves physically while receiving at least some of the video images from the projector; and a controller in communication with the projector, the controller being programmed to cause the projector to project the video images relative to the display surface, the video images at least partially depicting a randomly selected outcome of the wagering game;

wherein the controller coordinates animation of the video images projected via the projector with movement of the at least one moving section of the display surface, the movement of the at least one moving section corresponding to the structural features of the tangible object, the movement of the at least one moving section combining to simulate the tangible object.

24. The gaming system according to claim 23, wherein the at least one moving section is contoured to have a shape that corresponds to the tangible object.

25. The gaming system according to claim 23, wherein the video images received by the display surface represent a roulette wheel having a plurality of outcome identifiers arranged about a periphery of the roulette wheel, each outcome identifier corresponding to a randomly selected outcome in the wagering game, the wagering game being roulette.

26. The gaming system according to claim 25, wherein, to indicate the randomly selected outcome of the wagering game, the at least one moving section includes a rotating ring representing a spinning motion of the roulette wheel, and the video images projected onto the rotating ring represent the plurality of outcome identifiers and a roulette ball landing on one of the outcome identifiers.

27. The gaming system according to claim 26, wherein the rotating ring moves in coordination with the video images representing the plurality of outcome identifiers and the roulette ball.

28. The gaming system according to claim 26, wherein the display surface further includes an inner surface within the ring, the inner surface remaining stationary relative to the rotating annular section and receiving some of the video images.

29. The gaming system according to claim 26, wherein the at least one moving section includes a second moving section.

30. The gaming system according to claim 29, wherein the second moving section rotates at a speed or direction that is different from the rotating ring.

31. The gaming system according to claim 26, further comprising an illuminated ring disposed about the perimeter of the rotating ring, wherein the projector simultaneously provides light transmitted into the illuminated ring and the video images for the display surface.

32. The gaming system according to claim 23, wherein the controller is in operative communication with the at least one moving section of the display surface to control movement of the same, the controller being operable to synchronize movement of the at least one moving section with video images projected thereon by the projector.

* * * * *

UNITED STATES PATENT AND TRADEMARK OFFICE

CERTIFICATE OF CORRECTION

PATENT NO. : 8,449,372 B2
APPLICATION NO. : 12/742097
DATED : May 28, 2013
INVENTOR(S) : Glenn, II et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 376 days.

Signed and Sealed this
Eighth Day of September, 2015

Michelle K. Lee

Michelle K. Lee
*Director of the United States Patent and Trademark Office*